US010315874B2

(12) United States Patent
Krautkramer et al.

(10) Patent No.: US 10,315,874 B2
(45) Date of Patent: Jun. 11, 2019

(54) SHORT STRAIN CUTOFF DEVICE

(71) Applicant: Kimberly-Clark Worldwide, Inc., Neenah, WI (US)

(72) Inventors: Kyle Andrew Krautkramer, Kaukauna, WI (US); Matthew Robert Wilson, Oshkosh, WI (US); Daniel Mark Heinz, Greenville, WI (US); Robert Eugene Krautkramer, Combined Locks, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 746 days.

(21) Appl. No.: 14/783,554

(22) PCT Filed: Oct. 10, 2014

(86) PCT No.: PCT/US2014/060124
§ 371 (c)(1),
(2) Date: Oct. 9, 2015

(87) PCT Pub. No.: WO2016/057048
PCT Pub. Date: Apr. 14, 2016

(65) Prior Publication Data
US 2018/0201460 A1 Jul. 19, 2018

(51) Int. Cl.
*B65H 19/26* (2006.01)

(52) U.S. Cl.
CPC ..... *B65H 19/267* (2013.01); *B65H 2513/104* (2013.01); *B65H 2701/1924* (2013.01)

(58) Field of Classification Search
CPC ..... B26F 3/002; A47K 10/3612; A47K 2010/3668; Y10T 225/35; B65H 35/10; B65H 2408/235; B65H 19/26; B65H 19/28; B65H 2513/104; B65H 2513/108; B26H 301/41424; B26H 301/41812;
(Continued)

(56) References Cited

U.S. PATENT DOCUMENTS 4,583,698 A 4/1986 Nistri et al.
4,919,351 A * 4/1990 McNeil ..... B26D 1/626 225/105

(Continued)

FOREIGN PATENT DOCUMENTS

DE 3205801 A1 * 8/1983 ..... B26H 35/10

OTHER PUBLICATIONS

International Search Report and Written Opinion for International Application No. PCT/US2014/060124, dated Jul. 13, 2015.

*Primary Examiner* — Ghassem Alie
(74) *Attorney, Agent, or Firm* — Dority & Manning, P.A.

(57) ABSTRACT

A web break apparatus is disclosed for cutting and severing a web. The web break apparatus includes a first rotating device that rotates generally at the same speed as a moving web. Positioned on the circumference of the first rotating device is a web engaging device and a straining element. When a web break is desired, the web engaging device and straining element are brought into contact with the web. The web engaging device engages the web, while the straining element causes a web break. The web break apparatus may be used in any suitable winding system. For instance, the winding system may be for winding a web to produce rolled products.

21 Claims, 16 Drawing Sheets

(58) Field of Classification Search
CPC .... B26H 301/41824; B26H 301/41814; B26H 301/41826; B26H 301/41894
USPC ..... 225/4, 39, 100; 83/438; 242/521, 532.3, 242/533, 541.2, 542.1, 542.2, 542.4, 242/533.1, 533.2, 527.4, 533.4, 527.1
See application file for complete search history.

(56) References Cited

U.S. PATENT DOCUMENTS

| | | | | | |
|---|---|---|---|---|---|
| 5,899,406 | A | | 5/1999 | Payne | |
| 5,957,402 | A | | 9/1999 | McEathron et al. | |
| 6,003,421 | A | * | 12/1999 | Milich | B26D 1/045 242/527.4 |
| 6,006,669 | A | * | 12/1999 | Klein | B65H 37/04 101/485 |
| 6,056,229 | A | * | 5/2000 | Blume | B65H 19/2269 242/521 |
| 6,308,909 | B1 | * | 10/2001 | McNeil | B65H 19/26 242/521 |
| 6,419,217 | B1 | * | 7/2002 | Hartmann | B26D 9/00 198/369.2 |
| 8,800,908 | B2 | * | 8/2014 | McNeil | B65H 18/26 242/533.4 |
| 2001/0032903 | A1 | | 10/2001 | Durrance et al. | |
| 2008/0061182 | A1 | | 3/2008 | Wojcik et al. | |

* cited by examiner

SHORT STRAIN CUTOFF DEVICE

RELATED APPLICATIONS

The present application claims priority to PCT International Patent Application No. PCT/US2014/060124 filed on Oct. 10, 2014, which is hereby incorporated by reference in its entirety.

BACKGROUND

Winders are machines that roll lengths of paper, commonly known as paper webs, into rolls. These machines are capable of rolling lengths of web into rolls at high speeds through an automated process.

Turret winders are well known in the art. Conventional turret winders comprise a rotating turret assembly which support a plurality of mandrels for rotation about a turret axis. The mandrels travel in a circular path at a fixed distance from the turret axis. The mandrels engage hollow cores upon which a paper web can be wound. Typically, the paper web is unwound from a parent roll in a continuous fashion, and the turret winder rewinds the paper web onto the cores supported on the mandrels to provide individual, relatively small diameter logs. The rolled product log is then cut to designated lengths into the final product. Final products typically created by these machines and processes are toilet tissue rolls, paper toweling rolls, paper rolls, and the like.

The winding technique used in turret winders is known as center winding. A center winding apparatus, for instance, is disclosed in U.S. Pat. Reissue No. 28,353 to Nystrand, which is incorporated herein by reference. In center winding, a mandrel is rotated in order to wind a web into a roll/log, either with or without a core. Typically, the core is mounted on a mandrel that rotates at high speeds at the beginning of a winding cycle and then slows down as the size of the rolled product being wound increases, in order to maintain a constant surface speed, approximately matching web speed. Center winders work well when the web that is being wound has a printed, textured, or slippery surface. Also, typically, center winders are preferable for efficiently producing soft-wound, higher bulk rolled products.

A second type of winding is known in the art as surface winding. A machine that uses the technique of surface winding is disclosed in U.S. Pat. No. 4,583,698. Typically, in surface winding, the web is wound onto the core via contact and friction developed with rotating rollers. A nip is typically formed between two or more co-acting roller systems. In surface winding, the core and the web that is wound around the core are usually driven by rotating rollers that operate at approximately the same speed as the web speed. Surface winding is preferable for efficiently producing hard-wound, lower bulk rolled products.

A winding or rewinder system that can use both center winding and surface winding is disclosed in U.S. Pat. Nos. 8,459,587, 8,364,290, 8,262,011, 8,210,462, 8,042,761, and U.S. Pat. No. 7,909,282, which are all incorporated herein by reference. The rewinder system disclosed in the above patents has provided great advances in the art. In particular, the rewinder system disclosed in the above patents is capable of not only rapidly and efficiently producing spirally wound rolls of material, but the system is also capable of continuous operation even when a web break fault occurs.

The winding or rewinding systems disclosed in the above patents have made great advancements in the art. Further improvements, however, are still needed. For example, one issue needing attention is the ability to cut the moving web at high speeds so that the process is not interrupted. In U.S. Pat. No. 7,909,282, an apparatus for breaking a moving web is disclosed that utilizes first and second rotating arms that rotate at different speeds and cause a moving web to break. Although the apparatus disclosed in the '282 patent is well suited for many applications and processes, a need exists for an apparatus for breaking the web that can operate at even faster speeds without slowing down the process. In particular, a need exists for an apparatus for breaking a web at faster speeds that also maintains the leading edge of the web in a correct position.

SUMMARY

In general, the present disclosure is directed to a method and apparatus for breaking a moving web. The apparatus of the present disclosure can be incorporated into any suitable winding or rewinder system.

In one embodiment, the apparatus for breaking a moving web comprises a first rotating device in operative association with a drive device. The drive device is for rotating the first rotating device adjacent to a moving web. The first rotating device includes a circumference that is configured to move in the same direction as the moving web. In one embodiment, the circumference of the first rotating device may move at a speed that is substantially the same speed as the moving web. As used herein, substantially the same speed as the moving web refers to the circumference moving at a speed that is within 10% (10% greater or 10% less) of the speed of the moving web.

A web engaging device is located adjacent to the moving web for periodically engaging the web when a web break is needed or desired. The web engaging device may comprise a contact member or a suction device. For instance, the web engaging device may comprise a contact member located along the circumference of the first rotating device. The contact member may comprise a bar that extends the entire width of the moving web. The bar can have a web engaging surface that may comprise a pad member or a traction member. The pad member can be made from any suitable material, such as a closed cell foam, while the traction member may comprise a plate coated with a high traction material.

In an alternative embodiment, the web engaging device may comprise a suction device. The suction device may be positioned along the circumference of the first rotating device or may be positioned on the opposite side of the moving web in relation to the first rotating device.

The apparatus further comprises a straining element having a contact surface for contacting the moving web. In one embodiment, the straining element may be located along the circumference of the first rotating device.

In one particular embodiment, the straining element comprises a second rotating device positioned along the circumference of the first rotating device. The second rotating device has a contact surface that is configured to rotate at a speed greater than or less than the speed of the circumference of the first rotating device. In this manner, the contact surface of the second rotating device moves at a speed greater than or less than the speed of the moving web.

In order to break a moving web, the web engaging device engages the web while the straining element applies strain to the web causing the web to break.

In one embodiment, the straining element and the web engaging device may be positioned relatively close together when causing a web break. For instance, the web engaging device and the straining element can be spaced from one another such that the web engaging device engages the moving web at a distance of less than about 12 inches, such as less than about 10 inches, such as less than about 8 inches, such as less than about 6 inches, from where the contact surface of the straining element contacts the moving web. In one particular embodiment, the web engaging device engages the web at a distance less than about 4 inches, such as less than about 3 inches from where the contact surface of the straining element contacts the web.

In one embodiment, the web engaging device engages the moving web downstream from where the contact surface of the straining element contacts the web. In an alternative embodiment, the web engaging device contacts the moving web upstream from where the contact surface of the straining element contacts the web. As used herein, the distance between the web engaging device and the contact surface of the straining element is measured as the shortest distance between where the web is engaged by the web engaging device and where the web is contacted by the contacting surface of the straining element. For instance, when the web engaging device engages the web downstream from the straining element, the distance between the web engaging device and the straining element is measured from an upstream edge of the web engaging device to a downstream point of contact between the web and the contact surface of the straining element.

The contact surface of the straining element can move faster or slower than the speed of the circumference of the first rotating device in the same direction as the moving web. For instance, the speed of the contact surface of the straining element can be from about 10% to about 300%, such as from about 25% to about 50% faster or slower than the speed of the circumference of the first rotating device or faster or slower than the speed of the moving web.

In one embodiment, the apparatus can further include a positioning device that is configured to move the first rotating device towards and away from the moving web. The positioning device, for instance, can move the first rotating device towards the web in order to initiate a web break. When a web break is not desired, however, the first rotating device can be moved away from the web. In this manner, the first rotating device can continue to rotate at substantially the same speed as the web when a web break is not required. This configuration allows for fast response times for initiating a web break.

The apparatus may further include a controller, such as a programmable logic controller. The controller can control the position and speed of the first rotating device and the speed of the contact surface of the straining element. The controller can also be in communication with the positioning device for moving the first rotating device towards and away from the moving web. The controller can also monitor the position of the web engaging device and/or straining element on the first rotating device. The controller can monitor the speed and position of the different elements on the first rotating device through the use of sensors, through the use of an internal counting system, by a combination of both, or by any other suitable method.

The present disclosure is also directed to a winder for winding a web to produce a rolled product. The winder can include an unwind station for unwinding a web. A web transport apparatus conveys a web downstream from the unwind station. The web transport apparatus may comprise a conveyor belt and may include a vacuum for holding the web against the conveyor belt. The winder can include a plurality of winding modules positioned along the web transport apparatus. Each winding module can comprise a mandrel in operative association with a driving device for rotating the mandrel and a positioning apparatus in operative association with the mandrel. The positioning apparatus is configured to move the mandrel into and out of engagement with the conveyor belt. When placed in engagement with the conveyor belt, a nip is formed between the mandrel and the conveyor belt.

The mandrels are consecutively positioned along the web transport apparatus. A nip between the mandrel and the conveyor belt is used to contact a web being conveyed on the conveyor belt in order to initiate winding of the web onto the mandrel. In accordance with the present disclosure, the winder further includes an apparatus for breaking the moving web as described above. The apparatus for breaking the moving web can be positioned adjacent to the unwind station and be configured to break the web in order to form a new leading edge for initiating winding of the web onto one of the mandrels.

The present disclosure is also directed to a process for breaking a moving web without stopping the web. The process includes conveying a moving web on a conveying surface. The web may comprise a tissue web having a bulk greater than about 3 cc/g. A first rotating device is rotated adjacent to the moving web. The first rotating device includes a circumference that moves at substantially the same speed as the web. A straining element, such as a second rotating device, is located along the circumference of the first rotating device and includes a contact surface. The contact surface is moved at a speed greater or less than the speed of the circumference of the first rotating device. In order to cause a web break, the moving web is engaged by a web engaging device while the contact surface of the straining element contacts the web in close proximity to the web engaging device. The contact surface of the straining element applies strain to the moving web causing the web to break.

Of particular advantage, the above process can be carried out while the web is moving at a speed greater than 500 m/min, such as greater than about 800 m/min, such as greater than about 900 m/min, such as greater than about 1,000 m/min. The web generally moves at a speed of less than about 2,000 m/min.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
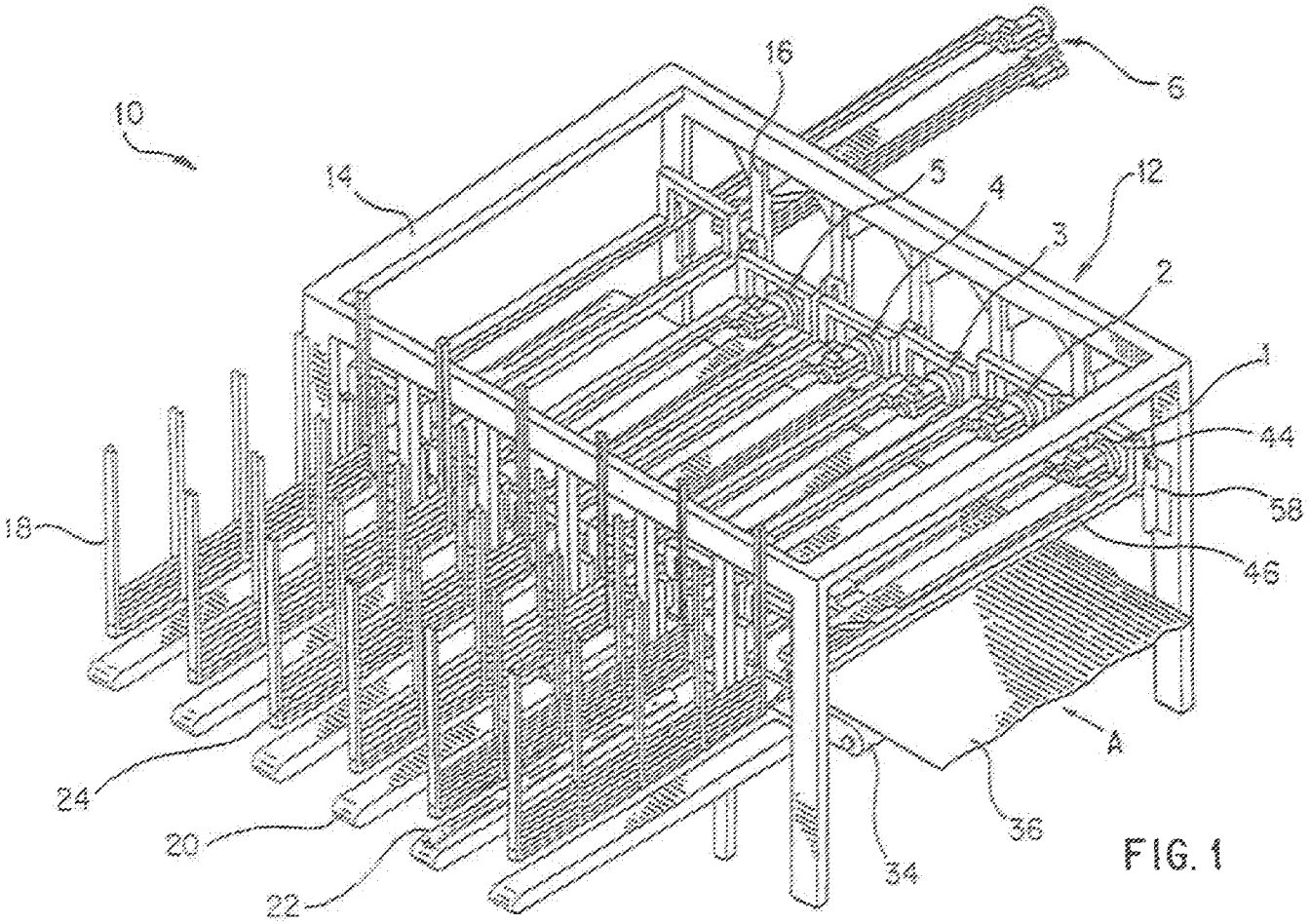
FIG. 1 is a perspective view of one exemplary embodiment of a winder. This winder includes a plurality of independent winding modules that are positioned in the web direction with respect to one another and substantially contained within a modular frame.

Repeat use of reference characters in the present specification and drawings is intended to represent the same or analogous features or elements of the present invention.

DETAILED DESCRIPTION

Reference will now be made in detail to exemplary embodiments of the invention, one or more examples of which are illustrated in the drawings. Each example is provided by way of explanation of the invention, and not meant as a limitation of the invention. For example, features illustrated or described as part of one exemplary embodiment can be used with another exemplary embodiment to yield still a third exemplary embodiment. It is intended that the present invention include these and other modifications and variations.

In general, the present disclosure is directed to an apparatus and method for breaking or cutting a web, while the web is moving. Of particular advantage, the apparatus is designed to form a break in the web without interrupting or slowing down the speed of the web. The web break apparatus of the present disclosure can be incorporated into numerous and different systems and processes, including winding and unwinding processes for tissue webs.

In one embodiment, for instance, the web break apparatus may be incorporated into a turret winding system that relies on center winding. Alternatively, the web break apparatus may be incorporated into a winding system that relies solely on surface winding. In yet another embodiment, the web break apparatus may be incorporated into a winding system that includes a plurality of independent winding modules as shown in the attached figures. The winding modules may wind the web into a rolled product by center winding, surface winding, and combinations of center and surface winding. This allows for the production of rolled products with varying degrees of softness and hardness. The attached figures, however, are provided for purposes of explanation and show one particular winding environment in which the apparatus may be incorporated.

In one embodiment, the web break apparatus of the present disclosure utilizes a web engaging device in combination with a straining element, which may comprise an underspeed roll or an overspeed roll. Both the web engaging device and the straining device can be attached or housed on a larger rotating device. The larger rotating device is positioned adjacent to a moving web and rotates in the same direction as the web. The rotating device, in one embodiment, can rotate such that the circumference of the device substantially matches the speed of the moving web. The rotating device can move towards and away from the moving web. In order to cause a web break, the web engaging device can engage the web while the rotating device can be moved towards the web causing a contact surface on the straining element to contact the moving web. The contact surface of the straining element works in conjunction with the web engaging device to apply sufficient strain to cause the web to break. Strain is applied to the web because the contact surface of the straining element moves at a speed differential in relation to the web engaging device.

The web break apparatus of the present disclosure can provide numerous advantages. For instance, due to the manner in which the apparatus is configured, the distance between the straining element and the web engaging device can be minimized which reduces the amount of total strain needed to sever the web. By minimizing the distance between the straining element and the web engaging device, less web disruption occurs not only allowing the apparatus to operate at higher speeds, but also preventing or inhibiting displacement of the web during the cutting or severing process.

In addition, as described above, the rotating device can rotate at substantially the same speed as the moving web and can be moved towards and away from the web. In this manner, the rotating device can, in one embodiment, continuously rotate while the web is being processed. In other words, the rotating device can remain in relative motion in relation to the web when a web cut is not needed. By remaining at or near the speed of the moving web between cutting cycles, the apparatus can cut the web almost instantaneously when a web break is desired. In addition, by remaining in relative motion, the web engaging device and straining element can be designed to have smaller dimensions, thus enabling them to be closer together and reducing the strain window.

In the past, a web break apparatus remained in a stationary state until a web break was needed. Thus, in order to effect a web break, the different elements had to be accelerated very quickly or have a large diameter to generate the necessary surface speeds at contact. The above limitations necessitated larger diameter elements that had slower reaction times with increased strain windows that limited the overall speed of the moving web when a web break was desired. The apparatus of the present disclosure, however, overcomes the above problems.

As described above, the web break apparatus of the present disclosure may be incorporated into any suitable web process system, such as a winder. In one embodiment, the winder may have a plurality of independent winding modules. Each individual winding module may wind the web such that if one or more modules are disabled, the remaining modules may continue to wind without interruption. This allows for operator servicing and routine maintenance or repairs of a module to be made without shutting down the winder. This configuration has particular advantages in that waste is eliminated and efficiency and speed of the production of the rolled product is improved.

A winding module 12 as described above is shown in FIG. 1 in order to wind a web 36 and form a rolled product 22. Although a plurality of independent winding modules 12 may be used to produce rolled products 22, the explanation of the functioning of only one winding module 12 is necessary in order to understand the building process of the rolled product 22.

Figure 5:
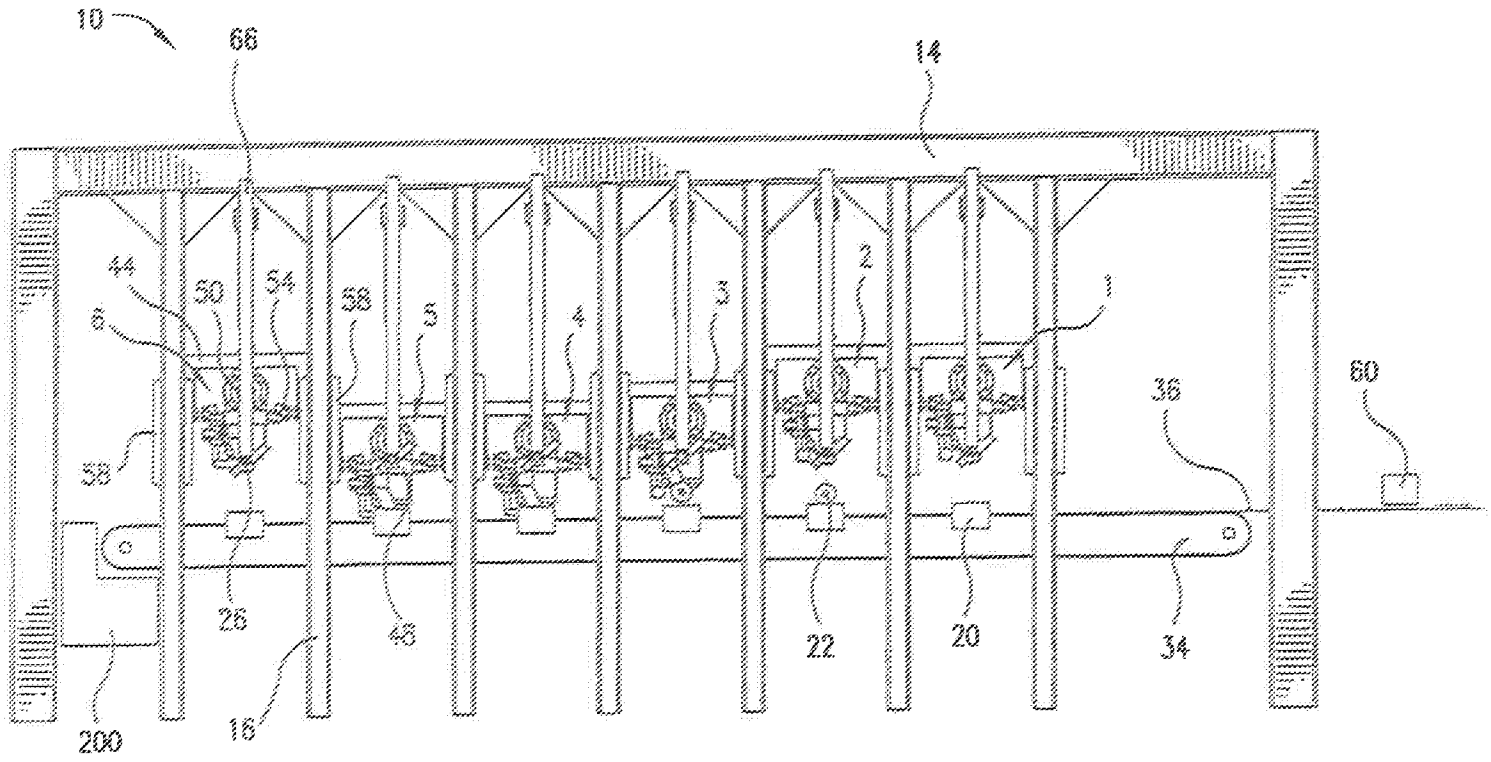
FIG. 5 is a side elevation view of an exemplary embodiment of a winder. The drawing shows winding modules in addition to other modules, which perform functions on a web.

Referring to FIG. 5, a web 36 is transported by a web transport apparatus 34 as shown. In accordance with the present disclosure, a web break apparatus or cutoff module 60 is positioned adjacent to the web 36 for cutting the web to a predetermined length.

Figure 10:
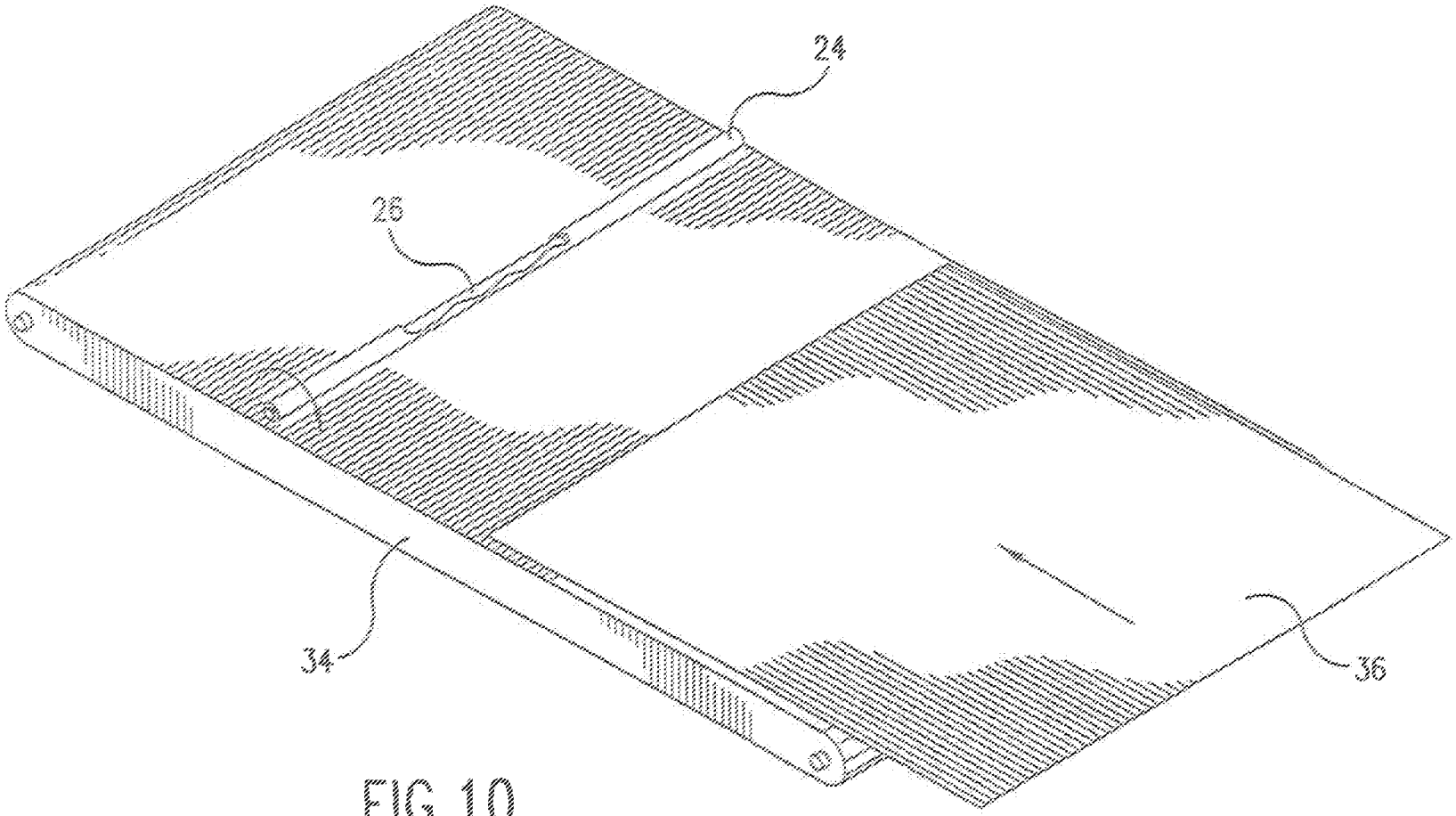
FIG. 10 is a perspective view of a web being transported by a web transport apparatus into proximity with a mandrel having a core.

Referring to FIG. 10, in one embodiment, the mandrel 26 is accelerated so that the speed of the mandrel 26 matches the speed of the web 36. Mandrel 26 has a core 24 located thereon. In other embodiments, however, the mandrel may not include a core for coreless winding. The mandrel 26 is lowered into a ready to wind position and awaits the web 36. The core 24 is moved into contact with the leading edge of the web 36. The web 36 is then wound onto core 24 and is attached to core 24 by, for instance, an adhesive previously applied to the core 24.

Figure 11:
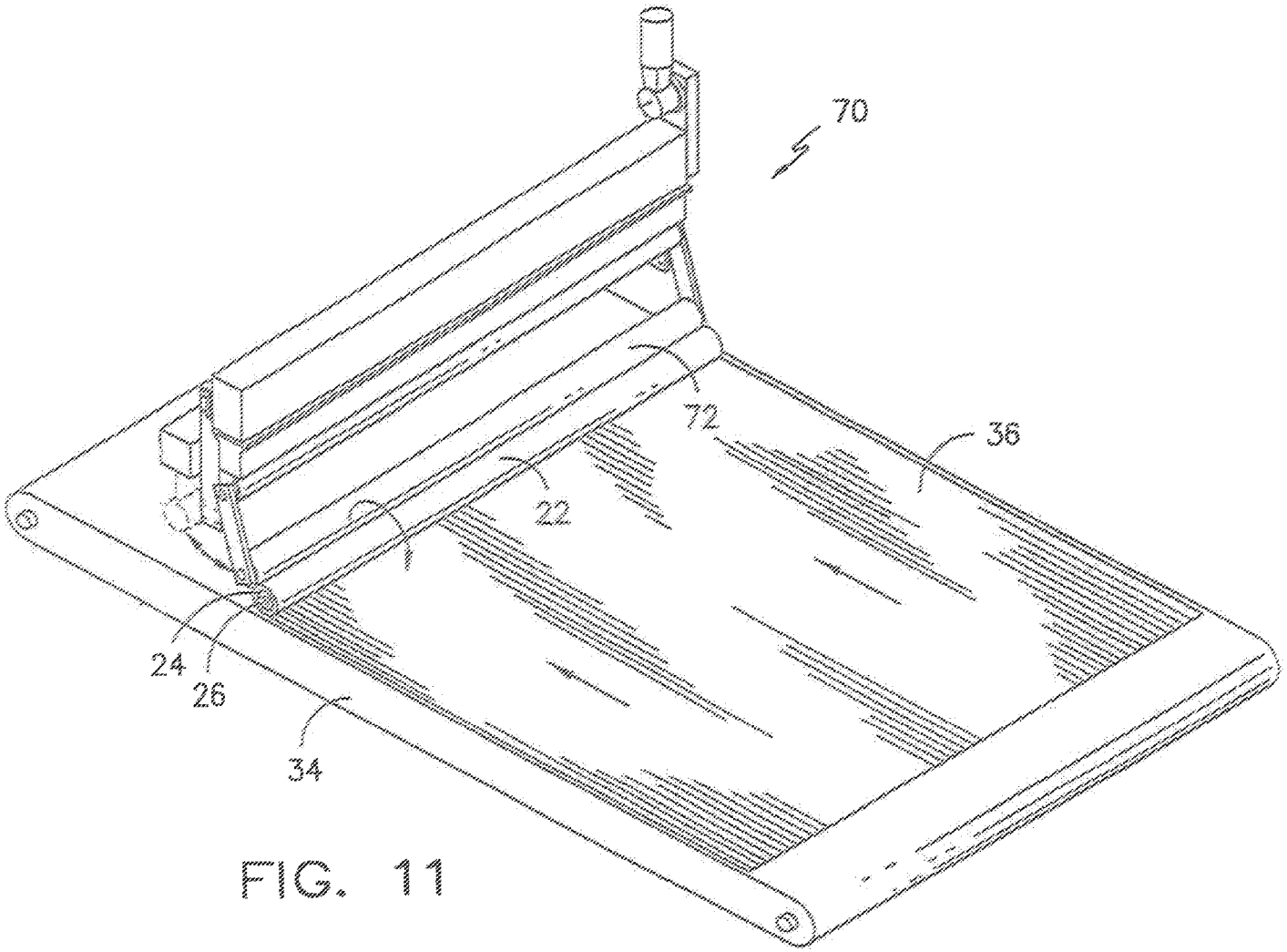
FIG. 11 is a perspective view of a rotating mandrel and core that are winding a web.

FIG. 11 shows the web 36 being wound onto the core 24. The winding of the web 36 onto core 24 may be controlled by the pressing of the core 24 onto the web transport apparatus 34 to form a nip. The magnitude with which the core 24 is pressed onto the web transport apparatus 34 creates a nip pressure that can control the winding of the web 36 onto the core 24. Additionally, the incoming tension of the web 36 can be controlled in order to effect the winding of the web 36 onto the core 24. Another control that is possible to wind the web 36 onto the core 24 involves the torque of the mandrel 26. Varying the torque on the mandrel 26 will cause a variance in the winding of the web 36 onto the core 24. All three of these types of winding controls, "nip, tension, and torque differential", can be employed. Also, the winding of the web 36 may be affected by using simply one or two of these controls.

The web 36 may be cut once the desired length of web 36 has been rolled onto the core 24 utilizing the web break apparatus 60 of the present disclosure. At this point, the leading edge of the next web 36 will be moved by the web transport apparatus 34 into contact with another winding module 12.

Referring to FIG. 11, the winding system can further include a tail sealing apparatus 70 that includes an adhesive applicator device 72. In one embodiment, a tail sealing apparatus 70 may be associated with each of the winding modules 12.

The tail sealing apparatus 70 is configured to apply an adhesive to the trailing edge of the web at a location so that the adhesive is placed in between the roll being formed and the outermost layer of the web. The adhesive therefore prevents the spirally wound rolls from unraveling during further processing and packaging of the rolls. As shown in the figures, the tail sealing apparatus can be incorporated directly in-line and apply adhesive while the rolls are being formed. In particular, the adhesive can be applied in order to seal the tail of the rolled product 22 before being unloaded to the rolled product transport apparatus 20.

In one embodiment, the web break apparatus 60 may work in combination with the tail sealing apparatus 70 to complete a finished rolled product. By cutting the web while the web remains moving, the web break apparatus 60 forms a new leading edge that can then be used to initiate winding of a new rolled product.

Figure 8A:
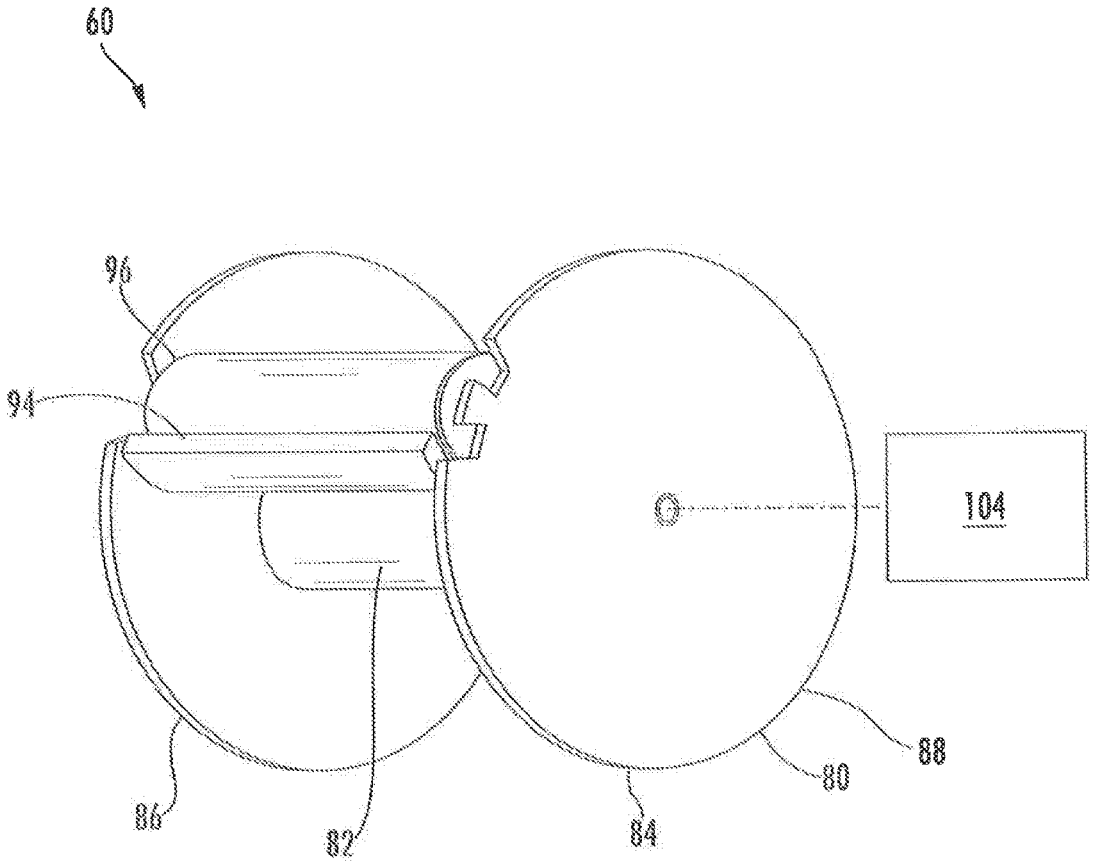
FIG. 8A is a perspective view of one embodiment of a web break apparatus made in accordance with the present disclosure.
Figure 8B:
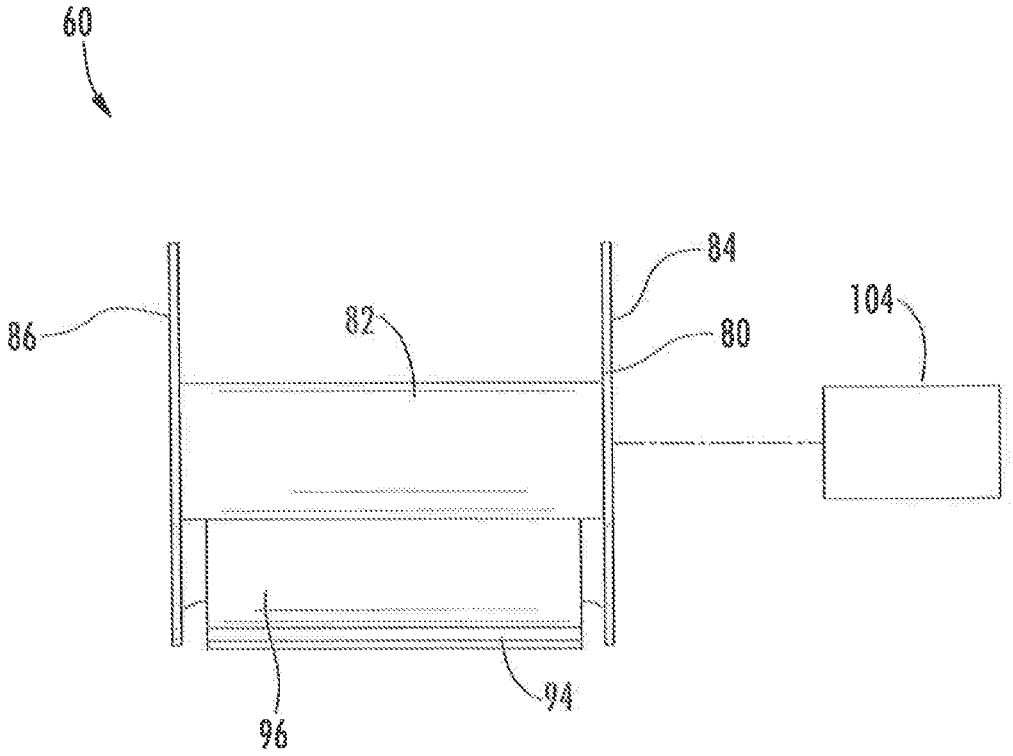
FIG. 8B is a plan view of the web break apparatus shown in FIG. 8A.
Figure 9:
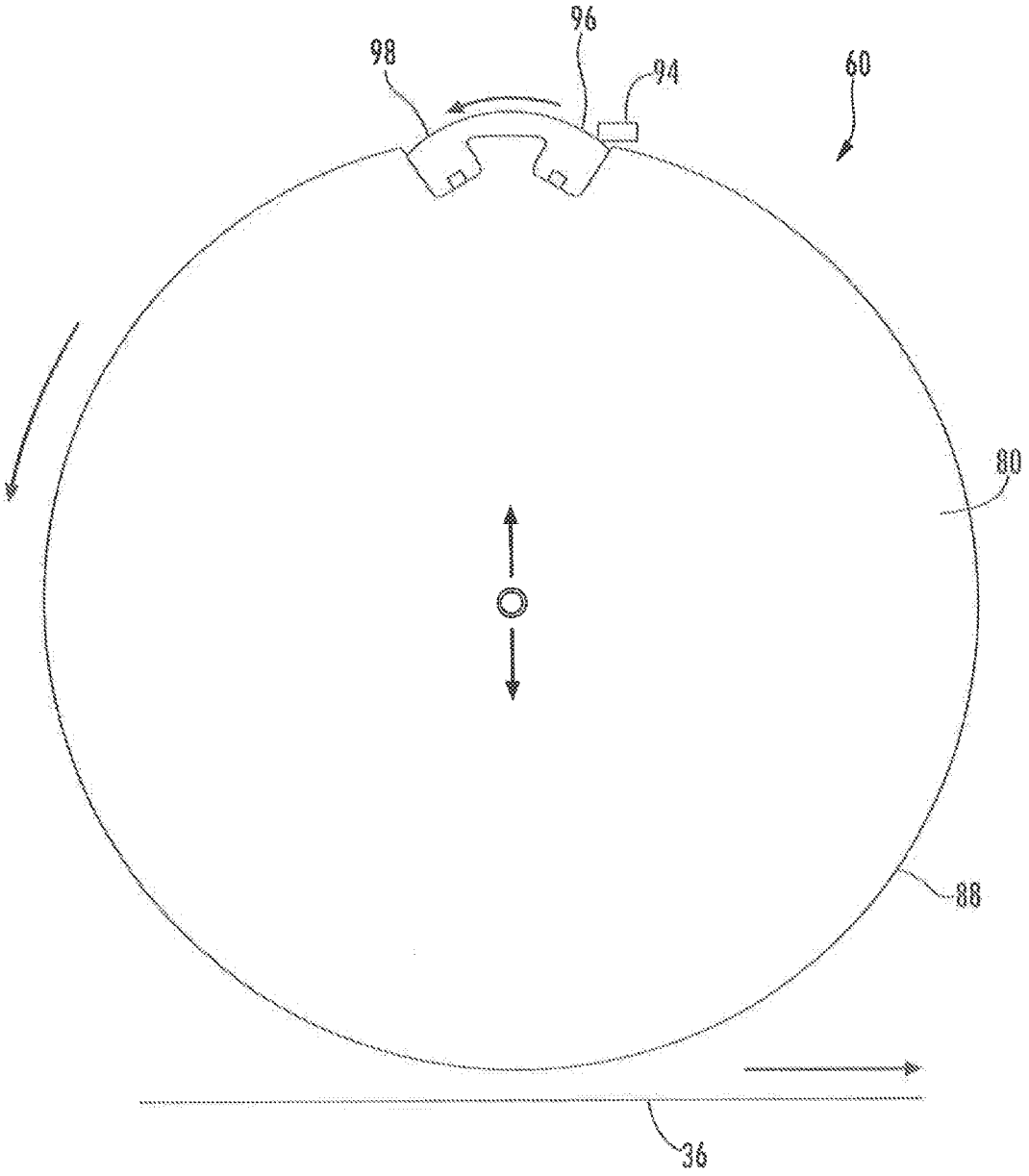
FIG. 9 is a side view of the web break apparatus of FIGS. 8A and 8B.

Referring to FIGS. 8A, 8B and 9, one embodiment of a web break apparatus 60 made in accordance with the present disclosure is shown. The web break apparatus 60 includes a first rotating device 80. In the embodiment illustrated, the rotating device 80 includes an axle 82 that connects a first hub 84 with a second hub 86. The hubs 84 and 86 define a circumference 88. In the embodiment illustrated, the circumference 88 is circular. It should be understood, however, that in other embodiments a non-circular circumference may also be suitable.

The first rotating device 80 is in operative association with a first drive device for rotating the first rotating device 80. Suitable drive devices are well known in the art and may comprise a motor operatively connected to the first rotating device 80. In one embodiment, as shown in FIG. 9, the first rotating device 80 may rotate in the same direction as the web 36. In one embodiment, a controller, such as a programmable logic controller, may monitor or sense the speed of the web 36 and rotate the first rotating device 80 such that the circumference 88 is moving at substantially the same speed as the web 36.

Referring back to FIG. 8A, the web break apparatus 60 further includes a web engaging device 94 that, in this embodiment, is located along the circumference 88 of the first rotating device 80. The web engaging device 94 rotates with the first rotating device 80 and is configured to contact the moving web 36 during a web break process. In one embodiment, the web engaging device 94 can be movable or adjustable so as to extend beyond the circumference 88 in a contact position and to extend inside of the circumference 88 in a non-contact position. In other embodiments, however, the web engaging device 94 may be stationary.

The web engaging device 94 can include a surface that is adapted to contact a moving web. In the embodiment illustrated in FIGS. 8A, 8B and 9, the web engaging device 94 comprises a bar having a contact member. The contact member may comprise a pad or a high traction coating. For instance, the pad can be made from a resilient material. In one embodiment, for instance, the pad can be made from a closed cell foam, such as a polyurethane foam. When the contact member is a pad, the pad provides a resilient surface that will deflect when contacted with the web 36. Consequently, the pad can stay in contact with the web 36 for an extended period of time as the first rotating device 80 rotates.

In an alternative embodiment, the contact member may comprise a high traction coating. For instance, the contact member may comprise a metal surface or a ceramic surface that includes a coating having sufficient friction so that the web will not slide below the surface during the web breaking process. In this embodiment, in order for the web engaging device to deflect when contacting the web 36, the web engaging device may be mounted in conjunction with a shock absorber, such as a spring.

The web break apparatus 60 further includes a straining element 96 that has a contact surface 98. In the embodiment illustrated in FIGS. 8A, 8B and 9, the straining element 96 comprises a second rotating device.

As shown in FIG. 9, the second rotating device is positioned along the circumference 88 of the first rotating device 80 and adjacent to the web engaging device 94. The second rotating device includes a circumference that extends beyond the circumference 88 of the first rotating device 80. The second rotating device rotates in the same direction as the first rotating device 80, but at a different speed. For instance, in one embodiment, the contact surface of the second rotating device may be moving faster than the circumference of the first rotating device and faster than the moving web 36 or may be moving slower than the circumference of the first rotating device and slower than the moving web 36. In the embodiment illustrated in the figures, the second rotating device comprises a rotating cylinder. In other embodiments, however, the rotating device may comprise a rotating shoe or pad or any other suitable construction.

The contact surface 98 of the second rotating device is designed to have sufficient friction to cause a web break as will be explained in greater detail below. In one embodiment, for instance, the second rotating device may be made from a carbon fiber roll and may include a high traction coating.

In general, the surface of the second rotating device and of the web engaging device 94 can be made from the same material or from different materials. In general, however, the surface of the second rotating device has a higher coefficient of friction than the surface of the web engaging device 94.

The second rotating device is in operative communication with a drive device for rotating the second rotating device. Suitable drive devices are known in the art and may comprise a motor. In one embodiment, a single drive device can drive both the first rotating device and the second rotating device.

As shown in FIGS. 8A and 8B, the web cutoff apparatus 60 may further include a positioning device 104. The positioning device 104 is for moving the first rotating device towards and away from a moving web 36 as shown in FIG. 9. In the embodiment illustrated, the positioning device 104 includes a motor and gear box arrangement. In other embodiments, however, the positioning device may comprise a pivot arm, a hydraulic or pneumatic cylinder, or any other suitable device capable of moving the assembly into an engagement position with the moving web 36 and into a non-engagement position.

In one embodiment, a controller, such as a microprocessor, a programmable logic controller, or other similar device, may be used to control the entire assembly for carrying out a web break at a desired time. For instance, in one embodiment, the controller can be in communication with the drive devices 90 and 100 and the positioning device 104. In addition, the controller may include a counter or various sensors in order to monitor the position of the web engaging device 94 and the second drive device 100 on the circumference 88 of the first rotating device 80.

During operation, as the web 36 is being unwound, the positioning device 104 maintains the first rotating device 80 into a non-engagement position. The first rotating device 80 is rotated such that the circumference of the device is moving at substantially the same speed as the web 36. The second rotating device can also be rotating simultaneously with the first rotating device 80. As described above, the second rotating device rotates such that the contact surface 98 of the device has a speed that is different than the speed of the circumference of the first rotating device 80. The web engaging device 94 can be maintained at a position adjacent to the second rotating device and beyond the circumference 88 of the first rotating device 80.

When a web break is desired, the positioning device 104 can move the first rotating device 80 into an engagement position with the moving web 36. The web engaging device 94 contacts the web along with the outer surface of the straining element 96, which may comprise the second rotating device. In one embodiment, for instance, the web engaging device may comprise a bar that extends the entire width of the moving web 36. The web engaging device engages the moving web 36 without slowing or stopping the web. In one embodiment, after the web engaging device has engaged the web 36, the contact surface of the second rotating device contacts the moving web. In the embodiment illustrated in FIG. 9, the contact surface 98 of the second rotating device is moving at a speed faster than the speed of the web 36. Due to the speed differential between the contact surface of the second rotating device and the moving web 36 while being engaged by the web engaging device, strain is created that causes the web to break between the web engaging device and the second rotating device.

The above configuration provides various advantages. For instance, because the first rotating device 90 rotates at near constant velocity, higher operational speeds and improved stability are obtained. The configuration also allows a minimized span length between the web engaging device 94 and the second rotating device. Reducing the span between the web engaging device 94 and the second rotating device reduces the amount of total strain needed to sever the web. Consequently, the reduced span length improves cut quality and minimizes wrinkles. In one embodiment, for instance, the distance between the web engaging device 94 and the second rotating device during a web break is less than about 6 inches, such as less than about 4 inches, such as even less than about 2 inches. The distance between the elements is at least about 0.2 inches.

Because the first rotating device 80 can remain in motion during the entire process, the web break apparatus 60 is also capable of operating at very high speeds. For instance, the web break apparatus can cause a break in the web 36 without interruption at speeds greater than 500 m/min, such as greater than about 700 m/min, such as greater than about 1,000 m/min.

In order to cause a web break, the speed difference between the web engaging device 94 via the first rotating device 80 and the circumference of the second rotating device can vary depending upon the type of web being processed. In general, the surface 98 of the second rotating device can be moving at a speed of from about 10% to about 300% greater than the speed of the circumference 88 of the first rotating device 80. In one embodiment, the difference in speed between the surface of the second rotating device and the speed of the circumference 88 of the first rotating device 80 can be less than about 50%, such as less than about 40%, such as less than about 30%. In one embodiment, for instance, the surface of the second rotating device can be moving at a speed of from about 25% to about 50% faster than the speed of the circumference of the first rotating device 80.

As shown in the figures, the second rotating device contacts the web 36 upstream from the web engaging device 94. In this arrangement, the surface of the second rotating device moves faster than the circumference of the first rotating device. In an alternative embodiment, however, the surface of the second rotating device may move slower than the circumference of the first rotating device (and slower than the web). In this embodiment, the web engaging device contacts the moving web upstream in relation to the second rotating device.

When causing a web break to occur, in one embodiment, the web engaging device contacts the web 36 before the straining element 96, which may comprise a second rotating device. The impact force of the web engaging device and rebound rate can be mechanically adjusted separately from the other elements of the system. In one embodiment, the web engaging device is maintained the same physical distance from the rotating device at all times. This distance, however, can be adjusted based on the material being processed.

Figure 16:
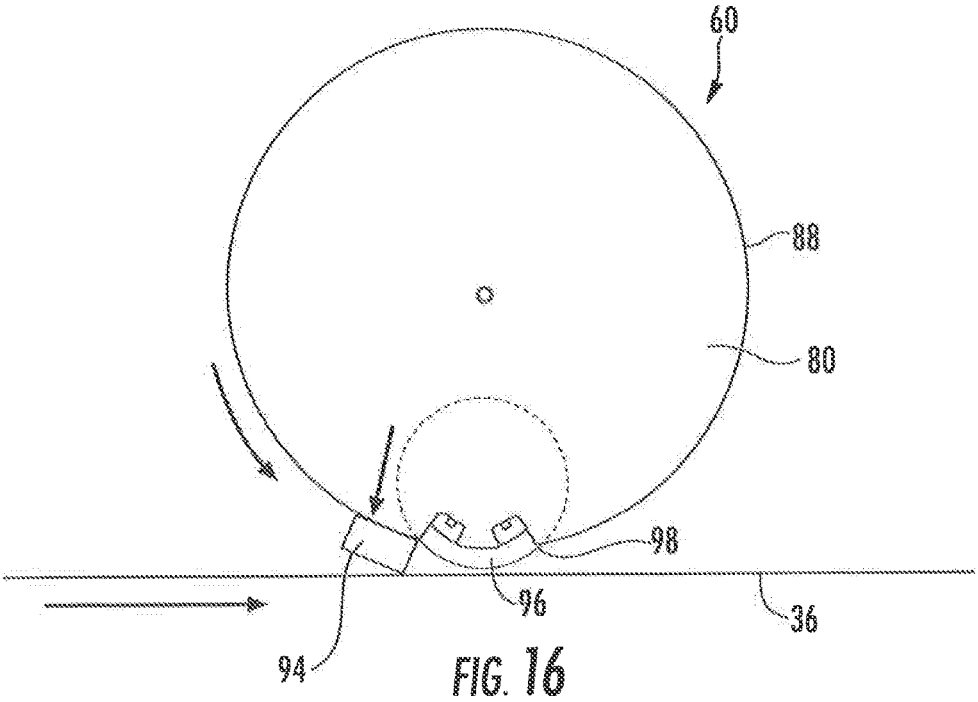
FIG. 16 is a side view of yet another embodiment of a web break apparatus made in accordance with the present disclosure.

In the embodiment illustrated in FIG. 9, the web engaging device comprises a contact member that contacts the web 36. In an alternative embodiment, however, the web engaging device may comprise a suction device that applies a suction force either directly or indirectly to the moving web 36. For instance, alternative embodiments of the web break apparatus 60 using a suction device as the web engaging device are shown in FIGS. 16 and 17. Like reference numerals have been used to indicate similar elements.

Figure 15:
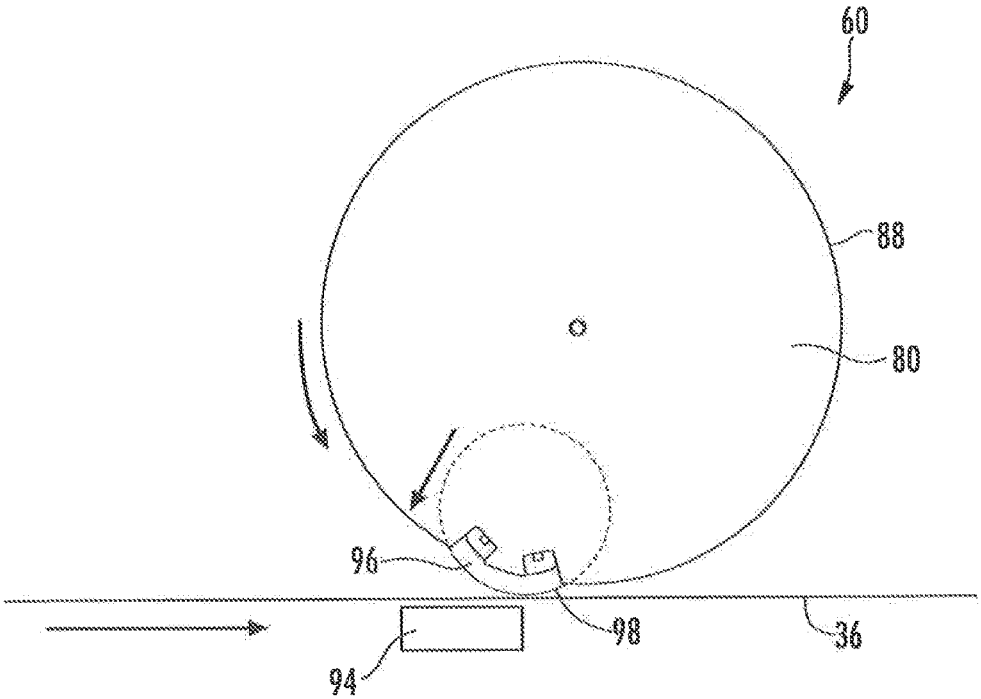
FIG. 15 is a side view of an alternative embodiment of a web break apparatus in accordance with the present disclosure.

As shown in FIG. 15, the web break apparatus 60 includes a first rotating device 80 having a circumference 88 connected to a straining element 96 having a web contact surface 98. In this embodiment, the web engaging device comprises a suction device 94. The suction device 94 is positioned opposite the first rotating device 80 on the opposite side of the moving web 36. When a web break is desired, the suction device 94 can apply a suction force to the web 36 for engaging the web while the contact surface of the straining element also contacts the web and creates the strain necessary for the web to break.

Referring to FIG. 16, another embodiment of a web break apparatus 60 is illustrated. In this embodiment, the web engaging device also comprises a suction device 94. Similar to the embodiment illustrated in FIG. 9, the suction device 94 is connected to the first rotating device 80 and extends beyond the circumference 88 of the first rotating device. As shown, the moving suction device 94 engages the web 36 while the contact surface 98 of the straining element 96 contacts the web 36 for breaking the web.

Once the moving web 36 is cut or severed, a new trailing end and leading edge are produced. The new leading edge is fed to a new mandrel for producing a rolled product. When the existing roll has about one wrap of the web yet to wind, the trailing end can be fed to the applicator device 72, which contacts the web and transfers an adhesive bead to the surface of the web.

More particularly, the adhesive is transferred to the web such that the adhesive is located in between the two most outermost layers of the roll being wound. Adjustment of the distance of the web yet unwound relative to the contact point of the applicator device 72 determines the amount of tail that is sealed to the roll being formed.

Figure 12:
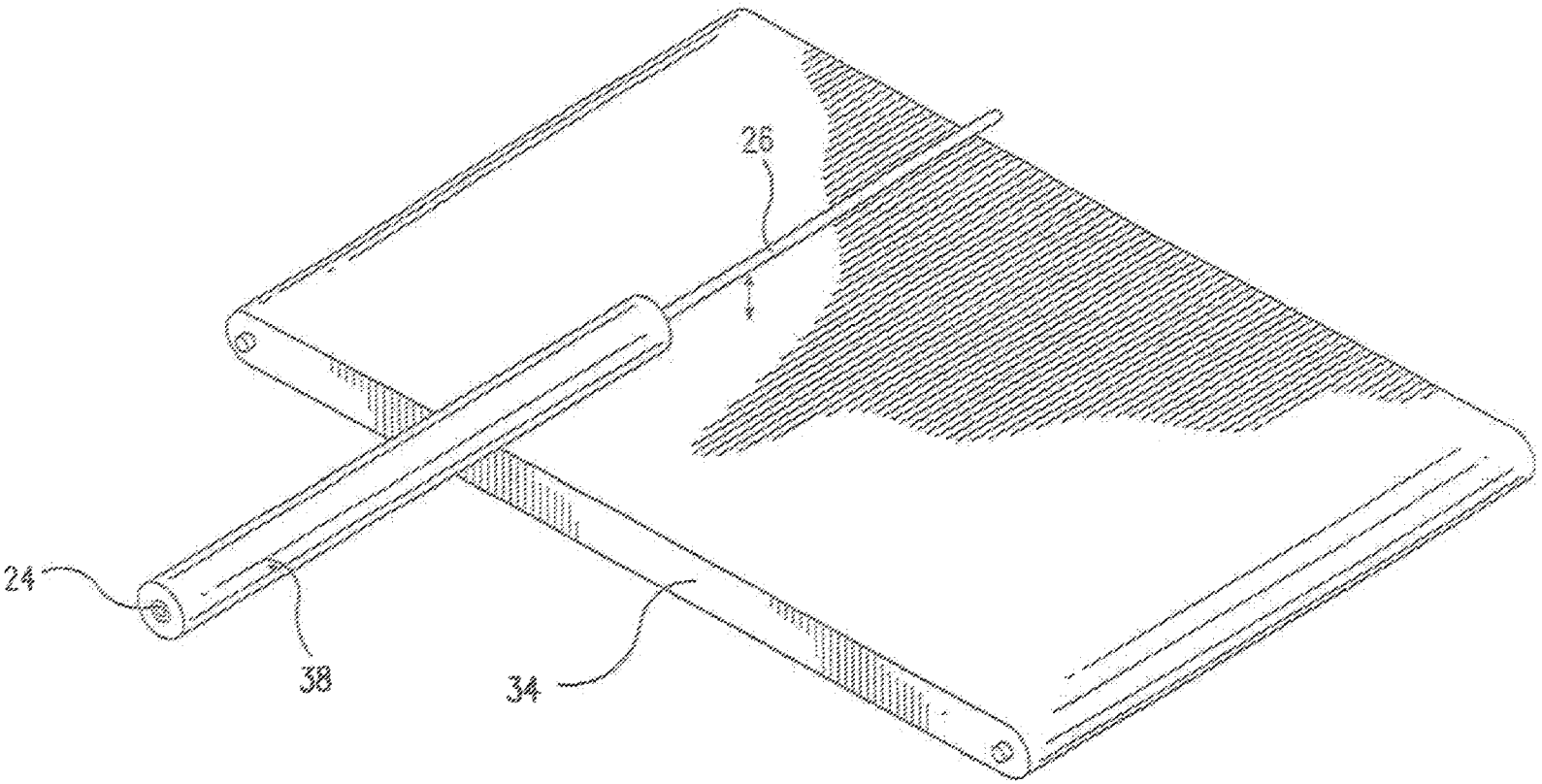
FIG. 12 is a perspective view of a rolled product with a core that is shown being stripped from a mandrel.

The completed rolled product can then be stripped from the mandrel. For instance, FIG. 12 shows the mandrel 26 being moved from a location immediately adjacent to the web transport apparatus 34 in FIG. 10 to a position slightly above the web transport apparatus 34. The wound length of web 36 is shown in FIG. 12 as being a rolled product 38 with a core 24. Now, a stripping function is carried out that moves the rolled product 38 with a core 24 off of the mandrel 26. This mechanism is shown as a product stripping apparatus 28 in FIG. 2. The rolled product 38 with a core 24 is moved onto a rolled product transport apparatus 20 as shown in FIGS. 1 and 2.

Figure 13:
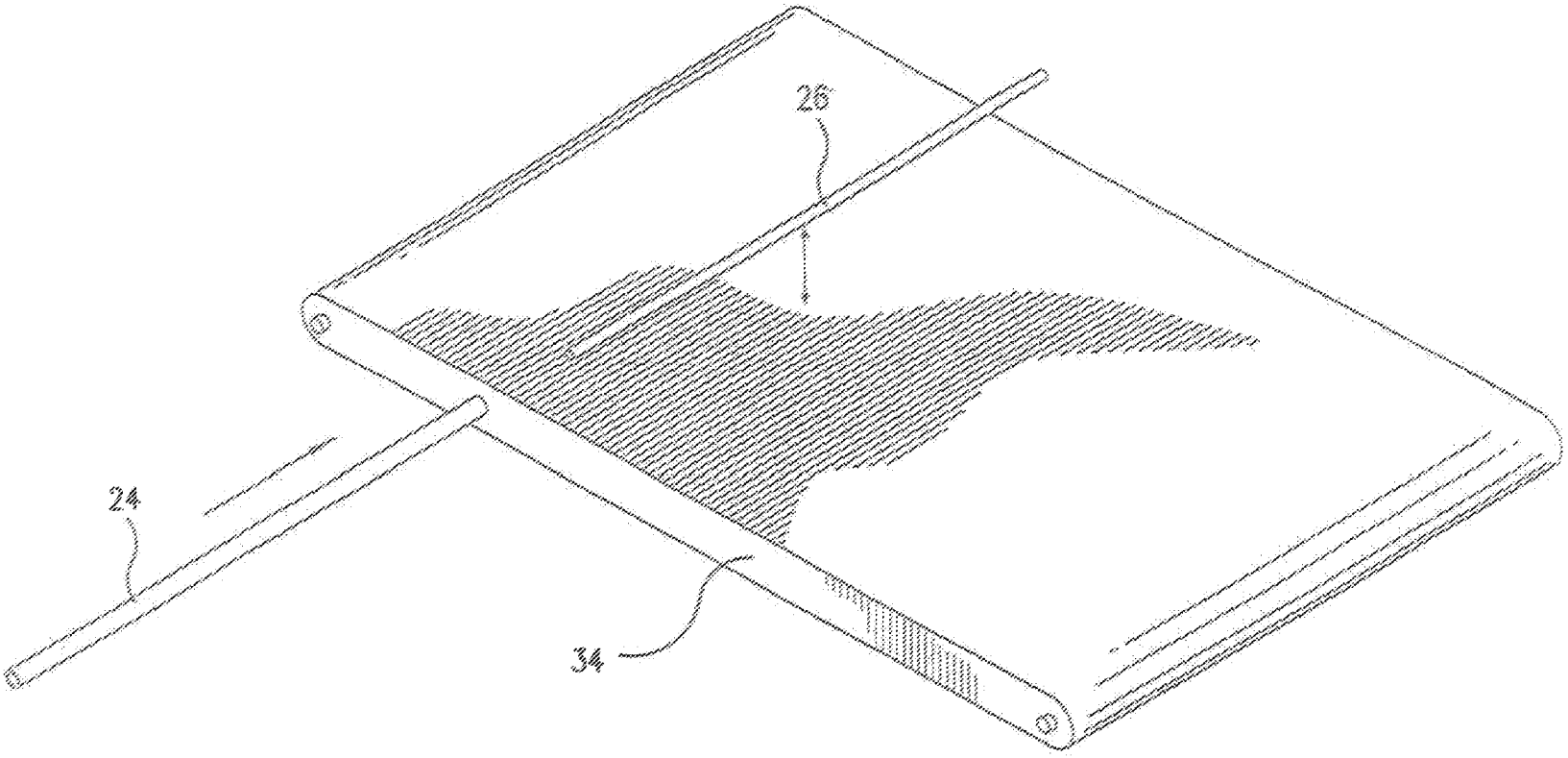
FIG. 13 is a perspective view of a mandrel that is in position to load a core.

Once the rolled product 38 with a core 24 is stripped from the mandrel 26, the mandrel 26 is moved into a core loading position as shown in FIG. 13. The product stripping apparatus 28 is shown in more detail in FIG. 2. Once the product stripping apparatus 28 finishes stripping the rolled product 38 with a core 24, the product stripping apparatus 28 is located at the end of the mandrel 26. This location acts to stabilize the mandrel 26 and prevent it from moving due to the cantilevered configuration of mandrel 26. In addition, the product stripping apparatus 28 helps to properly locate the end point of mandrel 26 for the loading of a core 24.

Figure 14:
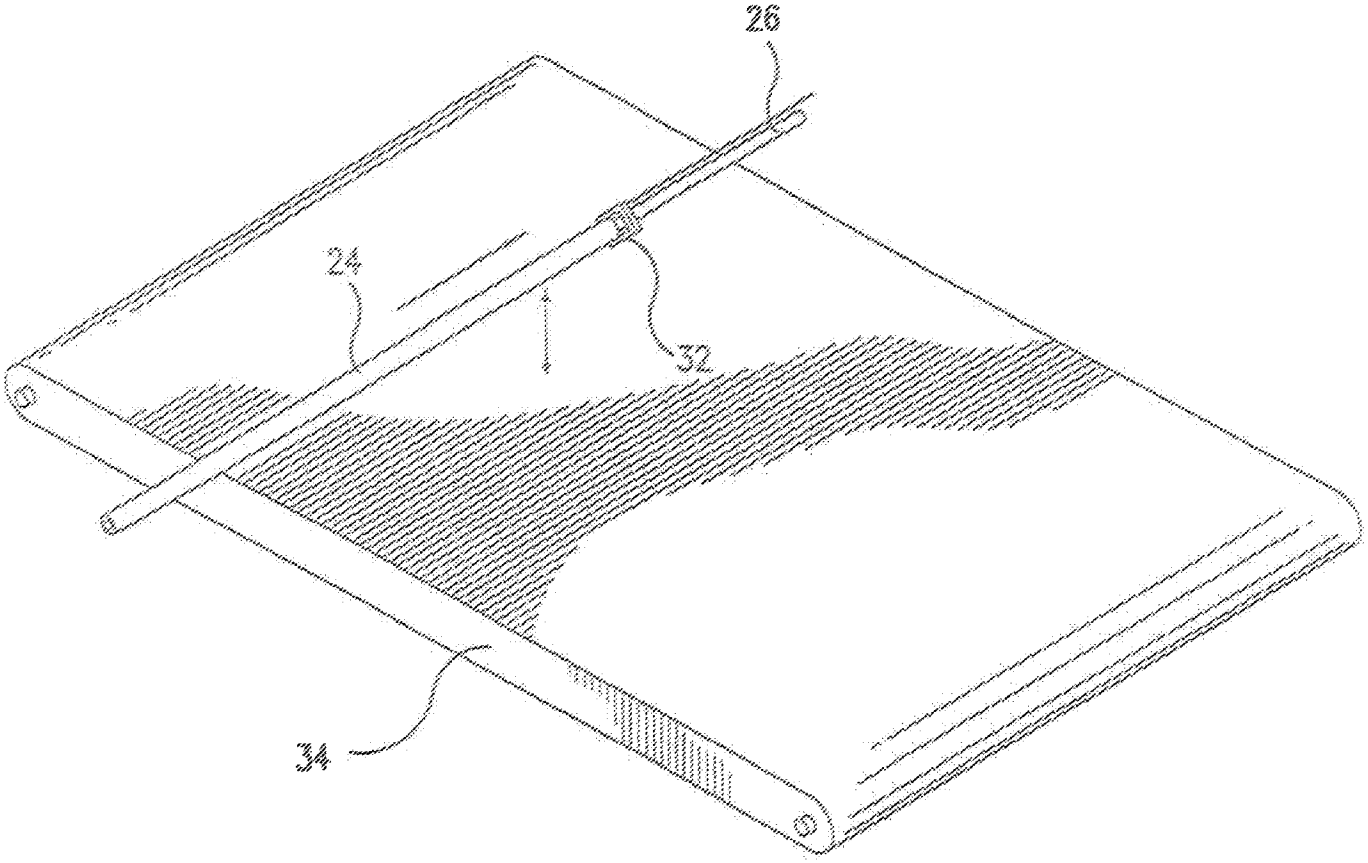
FIG. 14 is a perspective view that shows a core being loaded onto a mandrel via a core loading apparatus.

FIG. 14 shows one embodiment of a core 24 being loaded onto the mandrel 26. The loading of the core 24 is affected by a core loading apparatus 32. The product stripping apparatus may also serve as a core loading apparatus. The core loading apparatus 32 may be simply a frictional engagement between the core loading apparatus 32 and the core 24. However, the core loading apparatus 32 can be configured in other ways known in the art. In one embodiment of the present invention, once the core 24 is loaded, a cupping arm 70 (shown in FIG. 6) closes. Upon loading of the core 24 onto the mandrel 26, the mandrel 26 is moved into the ready to wind position as shown in FIG. 10. The cores 24 are located in a core supplying apparatus 18 as shown in FIGS. 1, 2, 3, and 4.

Figure 2:
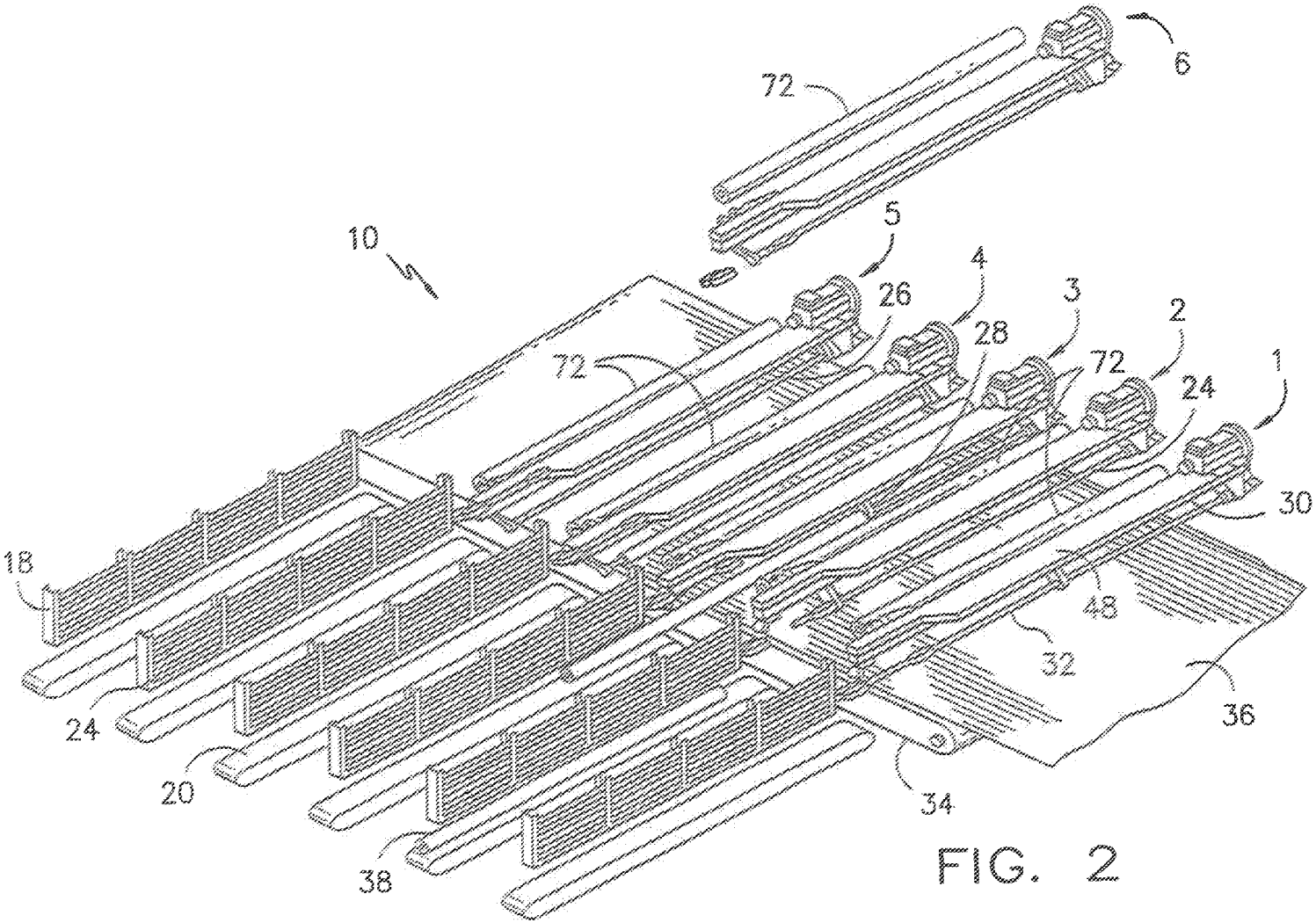
FIG. 2 is a perspective view of an exemplary embodiment of a winder. This drawing shows a plurality of independent winding modules, which are performing the various functions of a log winding cycle.

FIG. 1 shows an exemplary embodiment of a winder according to the invention as a "rewinder" 10 with a plurality of independent winding modules 12 arranged in a linear fashion with respect to one another. A frame 14 supports the plurality of independent winding modules 12. A web transport apparatus 34 is present which transports the web 36 for eventual contact with the plurality of independent winding modules 12. The frame 14 is composed of a plurality of posts 16 onto which the plurality of independent winding modules 12 are slidably engaged and supported. The frame 14 may also be comprised of modular frame sections that would engage each other to form a rigid structure. The number of modular frame sections would coincide with number of winding modules utilized.

Situated adjacent to the frame 14 are a series of core supplying apparatuses 18. A plurality of cores 24 may be included within each core supplying apparatus 18. These cores 24 may be used by the plurality of independent winding modules 12 to form rolled products 22. Once formed, the rolled products 22 may be removed from the plurality of independent winding modules 12 and placed onto a rolled product transport apparatus 20. The rolled product transport apparatus 20 is located proximate to the frame 14 and web transport apparatus 34.

FIG. 2 shows a rewinder 10 as substantially disclosed in FIG. 1 but having the frame 14 and other parts removed for clarity. In this exemplary embodiment, the plurality of independent winding modules 12 are composed of six winding modules 1-6. However, it is to be understood that the system can have any number of independent winding modules 12 being other than six in number. For instance, only one winding module 12 may be used in one exemplary embodiment. In alternative embodiments, the winding system may include five winding modules. In other embodiments, the winding system may include up to 18 winding modules. Each winding module 1-6 is shown performing a different function. Winding module 1 is shown in the process of loading a core 24 thereon. The plurality of independent winding modules 12 are provided with a core loading apparatus for placing a core 24 onto a mandrel 26 of the plurality of independent winding modules 12. Any number of variations of a core loading apparatus may be utilized. For instance, the core loading apparatus may be a combination of a rod that extends into the core supplying apparatus 18 and pushes a core 24 partially onto the mandrel 26 and a mechanism attached to the linear actuator of the product stripping apparatus 28 that frictionally engages and pulls the core 24 the remaining distance onto the mandrel 26. As shown in FIG. 2, winding module 1 is in the process of pulling a core 24 from the core supplying apparatus 18 and placing the core 24 on mandrel 26.

Winding module 2 is shown as having removed the rolled product 22 from its mandrel 26. The rolled product 22 is placed onto a rolled product transport apparatus 20. In this case, the rolled product 22 is a rolled product with a core 38. Such a rolled product with a core 38 is a rolled product 22 that is formed by having the web 36 being spirally wrapped around a core 24. It is to be understood that the rolled product 22 may also be a rolled product that does not have a core 24 and instead is simply a solid roll of wound web 36. It may also be the case that the rolled product 22 formed does not include a core 24, but has a cavity in the center of the rolled product 22. Various configurations of rolled product 22 may thus be formed in accordance with the present disclosure.

Each of the plurality of independent winding modules 12 is provided with a product stripping apparatus 28 that is used to remove the rolled product 22 from the winding modules 1-6. Winding module 3 is shown as being in the process of stripping a rolled product 22 from the winding module 3. The product stripping apparatus 28 is shown as being a flange which stabilizes the mandrel 26 and contacts an end of the rolled product 22 and pushes the rolled product 22 off of the mandrel 26. Also, the product stripping apparatus 28 helps locate the end of the mandrel 26 in the proper position for the loading of a core 24. The rolled product stripping apparatus 28 therefore is a mechanical apparatus that moves in the direction of the rolled product transport apparatus 20. The product stripping apparatus 28 may be configured differently in other exemplary embodiments of the invention.

The winding module 4 is shown as being in the process of winding the web 36 in order to form the rolled product 22. This winding process may be center winding, surface winding, or a combination of center and surface winding.

Winding module 5 is shown in a position where it is ready to wind the web 36 once the winding module 4 finishes winding the web 36 to produce a rolled product 22. In other words, winding module 5 is in a "ready to wind" position.

Winding module 6 is shown in FIG. 1 in a "racked out" position. It may be the case that winding module 6 has either faulted or is in need of routine maintenance and is therefore moved substantially out of frame 14 for access by maintenance or operations personnel. As such, winding module 6 is not in a position to wind the web 36 to produce rolled product 22, but the other five winding modules 1-5 are still able to function without interruption to produce the rolled product 22. By acting as individual winders, the plurality of independent winding modules 12 allow for uninterrupted production even when one or more of the winding modules becomes disabled.

Figure 4:
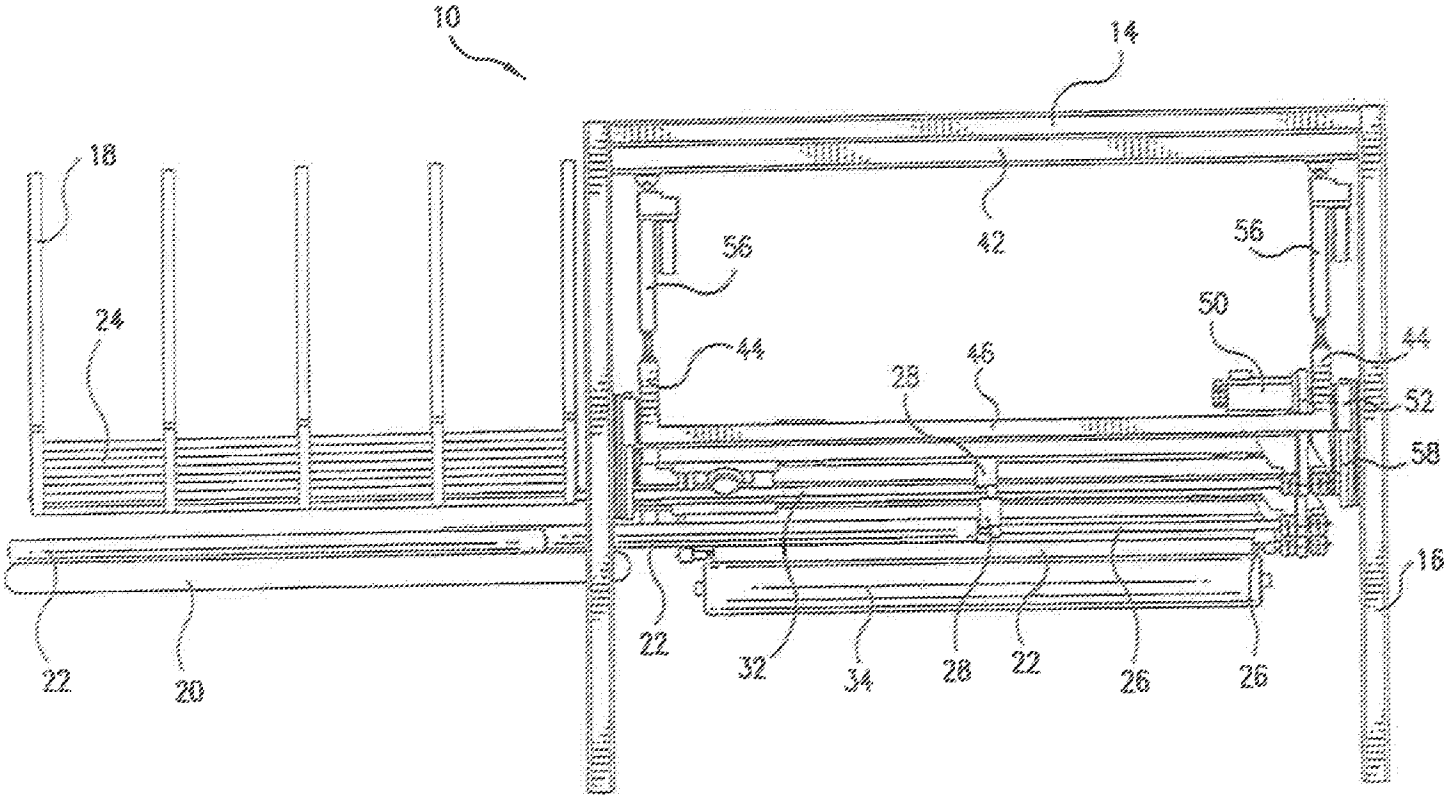
FIG. 4 is a front elevation view of an exemplary embodiment of a winder. The drawing shows a plurality of independent winding modules linearly situated with respect to one another and performing the various functions of a log winding cycle.

Each winding module 12 may have a positioning apparatus 56 (FIG. 4). The positioning apparatus 56 moves the winding module perpendicularly with respect to web transport apparatus 34, and in and out of engagement with web 36. Although the modules 12 are shown as being moved in a substantially vertical direction, other exemplary embodiments of the invention may have the modules 12 moved horizontally or even rotated into position with respect to web 36. Other ways of positioning the modules 12 can be envisioned.

Therefore, each of the plurality of independent winding modules 12 may be a self-contained unit and may perform the functions as described with respect to the winding modules 1-6. Winding module 1 may load a core 24 onto the mandrel 26 if a core 24 is desired for the particular rolled product 22 being produced. Next, the winding module 1 may be linearly positioned so as to be in a "ready to wind" position. Further, the mandrel 26 may be rotated to a desired rotational speed and then positioned by the positioning apparatus 56 in order to initiate contact with the web 36. The rotational speed of the mandrel 26 and the position of the winding module 1 with respect to the web 36 may be controlled during the building of the rolled product 22. After completion of the wind, the position of the module 1 with respect to the web 36 will be varied so that the winding module 1 is in a position to effect removal of the rolled product 22. The rolled product 22 may be removed by the product stripping apparatus 28 such that the rolled product 22 is placed on the rolled product transport apparatus 20. Finally, the winding module 1 may be positioned such that it is capable of loading a core 24 onto the mandrel 26 if so desired. Again, if a cureless rolled product were to be produced as the rolled product 22, the step of loading a core 24 would be skipped. It is to be understood that other exemplary embodiments of the present invention may have the core 24 loading operation and the core 24 stripping operation occur in the same or different positions with regard to the mandrel 26.

The rewinder 10 may form rolled products 22 that have varying characteristics by changing the type of winding process being utilized. The driven mandrel 26 allows for center winding of the web 36 in order to produce a low density, softer rolled product 22. The positioning apparatus 56 in combination with the web transport apparatus 34 allow for surface winding of the web 36 and the production of a high density, harder wound rolled product 22. Surface winding is induced by the contact between the core 24 and the web 36 to form a nip 68 (shown in FIG. 6) between the core 24 and the web transport apparatus 34. Once started, the nip 68 will be formed between the rolled product 22 as it is built and the web transport apparatus 34. As can be seen, the rewinder 10 therefore allows for both center winding and surface winding in order to produce rolled products 22. In addition, a combination of center winding and surface winding may be utilized in order to produce a rolled product 22 having varying characteristics. For instance, winding of the web 36 may be affected in part by rotation of the mandrel 26 (center winding) and in part by nip pressure applied by the positioning apparatus 56 onto the web 36 (surface winding). Therefore, the rewinder 10 may include an exemplary embodiment that allows for center winding, surface winding, and any combination in between. Additionally, as an option to using a motor to control the mandrel speed/torque a braking device (not shown) on the winding modules 12 may be present in order to further control the surface and center winding procedures.

The plurality of independent winding modules 12 may be adjusted in order to accommodate for the building of the rolled product 22. For instance, if surface winding were desired, the pressure between the rolled product 22 as it is being built and the web transport apparatus 34 may be adjusted by the use of the positioning apparatus 56 during the building of the rolled product 22.

Utilizing a plurality of independent winding modules 12 allows for a rewinder 10 that is capable of simultaneously producing rolled product 22 having varying attributes. For instance, the rolled products 22 that are produced may be made such that they have different sheet counts. Also, the rewinder 10 can be run at both high and low cycle rates with the modules 12 being set up in the most efficient manner for the rolled product 22 being built. The winding modules 12 may have winding controls specific to each module 12, with a common machine control. Real time changes may be made where different types of rolled products 22 are produced without having to significantly modify or stop the rewinder 10. Real time roll attributes can be measured and controlled.

Figure 3:
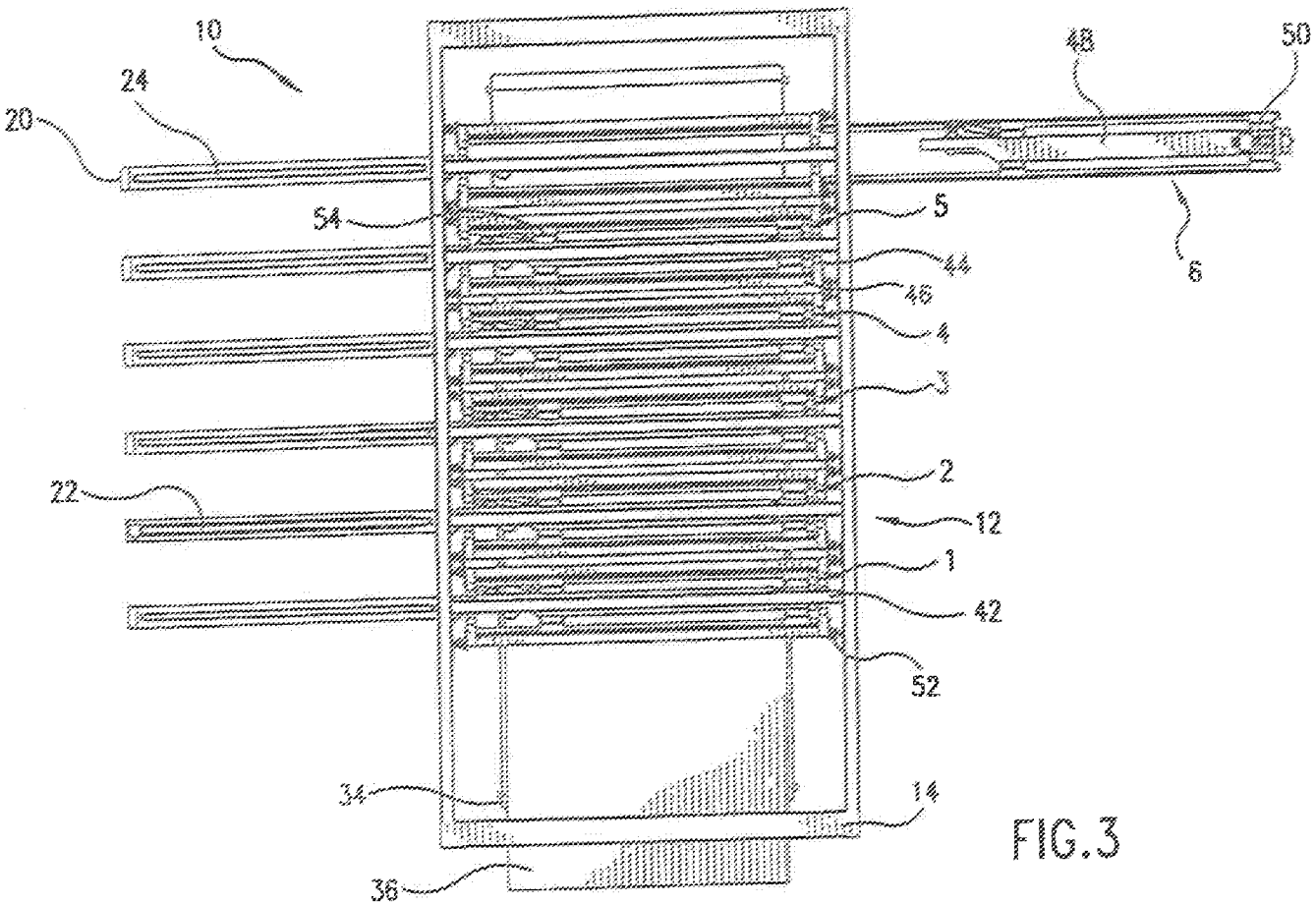
FIG. 3 is a plan view of an exemplary embodiment of a winder. The drawing shows a plurality of independent winding modules linearly situated with respect to one another and performing the various functions of a log winding cycle.

FIG. 3 shows a rewinder 10 having a frame 14 disposed about a plurality of independent winding modules 12. The frame 14 has a plurality of cross members 42 transversing the ends of the frame 14. The positioning apparatus 56 that communicates with the winding modules 1-6 is engaged on one end to the cross members 42, as shown in FIG. 4. A vertical linear support member 44 is present on the plurality of independent winding modules 12 in order to provide an attachment mechanism for the positioning apparatus 56 and to provide for stability of the winding modules. The positioning apparatus 56 may be a driven roller screw actuator. However, other means of positioning the plurality of independent winding modules 12 may be utilized. The vertical support members 44 also may engage a vertical linear slide support 58 that is attached to posts 16 on frame 14. Such a connection may be of various configurations, for instance a linear bearing or a sliding rail connection. Such a connection is shown as a vertical linear slide 52 that rides within the vertical linear slide support 58 in FIG. 4.

Figure 6:
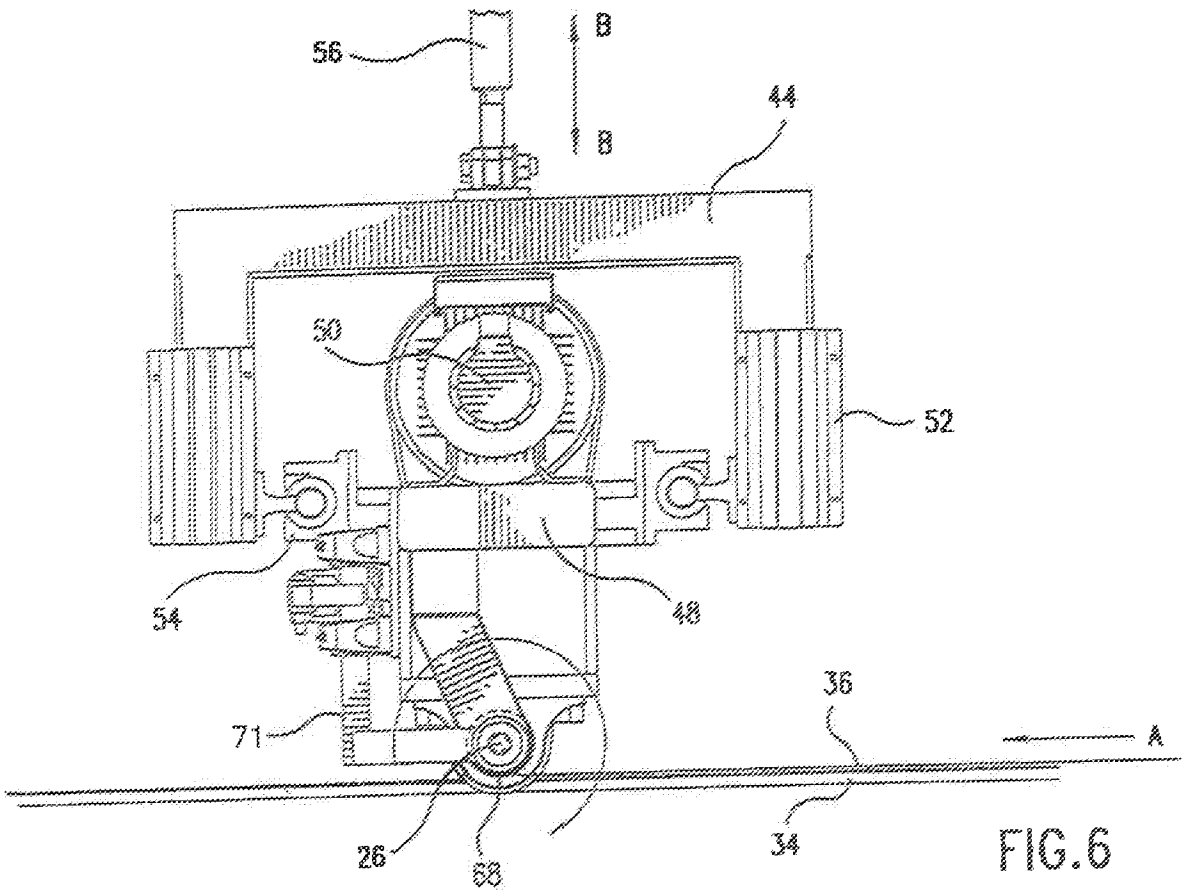
FIG. 6 is a side elevation view of an exemplary embodiment of an independent winding module. The drawing shows the winding module engaging a web and forming a rolled product.

A horizontal linear support member 46 is also present in the plurality of independent winding modules 12. The horizontal linear support member 46 may communicate with a horizontal linear slide 54 (as shown in FIG. 6) to allow some or all of the plurality of independent winding modules 12 to be moved outside of the frame 14. The horizontal linear slide 54 may be a linear rail type connection. However, various configurations may be possible.

FIG. 6 shows a close up view of an exemplary embodiment of a winding module. A servomotor 50 can be supported by the module frame 48 onto which a mandrel cupping arm 71 is configured. The mandrel cupping arm 71 is used to engage and support the end of the mandrel 26 opposite the drive during winding. As can be seen, the positioning apparatus 56 may move the winding module for engagement onto the web 36 as the web 36 is transported by the web transport apparatus 34. Doing so will produce a nip 68 at the point of contact between the mandrel 26 and the transport apparatus 34, with the web 36 thereafter being wound onto the mandrel 26 to produce a rolled product 22.

Figure 7:
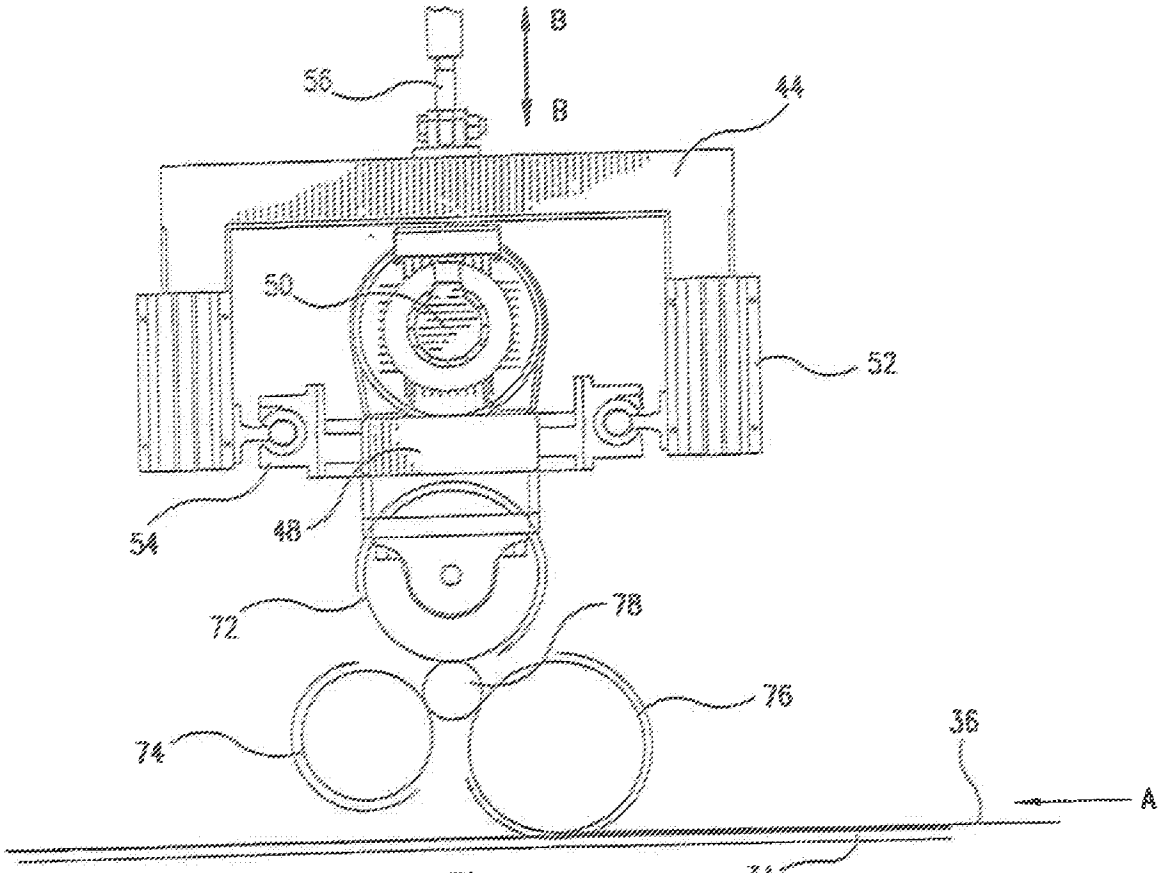
FIG. 7 is a side elevation view of an exemplary embodiment of a winding module. The drawing shows the winding module using rolls to form a rolled product via surface winding only.

FIG. 7 shows another exemplary embodiment of a winder module. The exemplary embodiment in FIG. 7 is substantially similar to the exemplary embodiment shown in FIG. 6 with the exception of having the winding process being a pure surface procedure. A drum roll 72 is located at approximately the same location as the mandrel 26 of FIG. 6. In addition, the exemplary embodiment shown in FIG. 7 also has another drum roll 74 along with a vacuum roll 76. In operation, the web 36 is conveyed by the web transport apparatus 34 in the direction of arrow A. The web transport apparatus 34 may be a vacuum conveyor or a vacuum roll. However, it is to be understood that a variety of web transport apparatus 34 may be utilized, and the present invention is not limited to one specific type. Another exemplary embodiment, for instance, may include web transport apparatus 34 that is an electrostatic belt that uses an electrostatic charge to keep the web 36 on the belt. The vacuum roll 76 draws the web 36 from the web transport apparatus 34 and pulls it against the vacuum roll 76. The web 36 is then rotated around the vacuum roll 76 until it reaches a location approximately equal distance from the drum roll 72, drum roll 74, and vacuum roll 76. At such time, the web 36 is no longer pulled by the vacuum in the vacuum roll 76 and is thus able to be rolled into a rolled product 22 by way of surface winding by the drum roll 72, drum roll 74, and vacuum roll 76. The rolled product 22 that is formed in the exemplary embodiment shown in FIG. 7 is a coreless rolled product without a cavity 78. The winding module may also be modified such that more than or fewer than three rolls are used to achieve the surface winding process. Further, the production of the rolled product 22 having a core 24 or a coreless cavity in the rolled product 22 can be achieved in other exemplary embodiments using a similar configuration as shown in FIG. 7.

Shown in FIG. 5 is a waste removal apparatus 200 for removing extra web 36 that results from faults such, as web breaks, and machine start ups. This waste is moved to the end of the web transfer apparatus 34 and then removed. The use of a plurality of individual modules 12 reduces the amount of waste because once a fault is detected, the affected module 12 is shut down before the rolled product is completely wound. The web is severed on the fly and a new leading edge is transferred to the next available module. Any waste is moved to the end of the web transfer apparatus 34 and then removed.

It is believed that using a web transport apparatus 34 that has a vacuum conveyor or a vacuum roll will aid in damping the mandrel 26 vibrations that occur during transfer of the web 36 onto the mandrel and also during the winding of the mandrel 26 to form a rolled product 22. Doing so will allow for higher machine speeds and hence improve the output of the rewinder 10.

Each of the winder modules 1-6 of the plurality of independent winding modules 12 do not rely on the successful operation of any of the other modules 1-6. This allows the rewinder 10 to operate whenever commonly occurring problems during the winding process arise. Such problems could include for instance web breaks, ballooned rolls, missed transfers, and core loading errors. The rewinder 10 therefore will not have to shut down whenever one or more of these problems occurs because the winding modules 1-6 can be programmed to sense a problem and work around the particular problem without shutting down. For instance, if a web break problem occurred, the rewinder 10 may perform a web cut by a cut-off module 60 and then initiate a new transfer sequence in order to start a new winding about the next available winding module 1-6. Any portion of the web 36 that was not wound would travel to the end of the web transport apparatus 34 where a waste removal apparatus 200 could be used to remove and transport the waste to a location remote from the rewinder 10. The waste removal apparatus 200 could be for instance an air conveying system. The winding module 1-6 whose winding cycle was interrupted due to the web break could then be positioned accordingly and initiate removal of the improperly formed rolled product 22. Subsequently, the winding module 1-6 could resume normal operation. During this entire time, the rewinder 10 would not have to shut down.

It should be understood that the invention includes various modifications that can be made to the exemplary embodiments of the center/surface rewinder/winder described herein as come within the scope of the appended claims and their equivalents. Further, it is to be understood that the term "winder" as used in the claims is broad enough to cover both a winder and a rewinder.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for breaking a moving web without stopping the web comprising:

conveying the moving web on a conveyor belt;

rotating a first rotating device, the first rotating device including a circumference, the circumference moving in the same direction as the web, the circumference having a rotational speed;

moving a contact surface of a straining element located along the circumference of the first rotating device, the contact surface moving at a speed greater or less than the speed of the circumference of the first rotating device;

engaging the moving web with a web engaging device, wherein while the web is engaged by the web engaging device, the contact surface of the straining element contacts the web and creates strain against the web engaging device causing the web to break, forming a leading edge within the moving web; and conveying the leading edge on the conveyor belt.

2. A process as defined in claim 1, wherein the web is moving at a speed of from about 500 m/min to about 2,000 m/min.

3. A process as defined in claim 1, wherein the web engaging device contacts the moving web at a distance of less than about 4 inches downstream or upstream from the contact surface of the straining element.

4. A process as defined in claim 1, wherein the moving web comprises a tissue web.

5. A process as defined in claim 1, wherein the straining element comprises a second rotating device located along the circumference of the first rotating device and wherein the web engaging device comprises a suction device or a contact member.

6. A process as defined in claim 5, wherein the web engaging device comprises the contact member, the contact member comprises a pad.

7. A process as defined in claim 1, wherein in order to contact the moving web with the straining element, the first rotating device is moved toward a surface of the web and, after a web break, the first rotating device is moved away from a surface of the moving web.

8. An apparatus for breaking a moving web comprising:

a conveyor belt conveying a moving web at a first speed;

a first rotating device in operative association with a drive device, the drive device for rotating the first rotating device adjacent to the moving web, the first rotating device including a circumference that is configured to move in the same direction as the moving web;

a web engaging device being positioned to momentarily engage the moving web;

a straining element located on the circumference of the first rotating device, the straining element having a contact surface that is configured to move at a second speed, the second speed being greater or less than the first speed of the moving web, forming a speed differential between the first speed and the second speed; and wherein, in order to break the moving web, the web engaging device momentarily engages the moving web while the contact surface of the straining element contacts the web at the speed differential that creates strain and breaks the moving web to form a leading edge within the moving web, and wherein the apparatus is configured to inhibit displacement of the leading edge from the conveyor belt.

9. An apparatus as defined in claim 8, wherein, during a web break, the speed of the contact surface of the straining element is from about 10% to about 300% faster or slower than the speed of the moving web.

10. An apparatus as defined in claim 8, wherein, during a web break, the speed of the contact surface of the straining element is from about 25% to about 50% faster or slower than the speed of the moving web.

11. An apparatus as defined in claim 8, wherein the web engaging device is connected to the first rotating device and comprises a pad that extends beyond the circumference of the first rotating device.

12. An apparatus as defined in claim 11, wherein the pad comprises a closed cell foam.

13. An apparatus as defined in claim 8, wherein the straining element comprises a second rotating device that is configured to rotate such that the contact surface moves at the second speed.

14. An apparatus as defined in claim 8, further comprising a positioning device that is configured to move the first rotating device towards and away from the moving web.

15. An apparatus as defined in claim 8, further comprising a controller in communication with the drive device.

16. An apparatus as defined in claim 15, wherein the controller is programmed to control a web break by monitoring the position of the web engaging device in relation to the moving web, rotating the first rotating device at a third speed that is within 10% of the first speed of the moving web, moving the contact surface of the straining element at the second speed and causing the web engaging device and the straining element to contact the moving web at a desired location for causing a web break.

17. An apparatus as defined in claim 8, wherein the web engaging device comprises a suction device that applies a suction force to the moving web.

18. An apparatus as defined in claim 17, wherein the suction device is connected to the first rotating device along the circumference of the first rotating device, the suction device being positioned adjacent to the straining element.

19. An apparatus as defined in claim 17, wherein the suction device is positioned opposite the circumference of the first rotating device such that the moving web can travel in between the first rotating device and the suction device.

20. An apparatus as defined in claim 8, wherein the web engaging device and the straining element are spaced from one another such that the web engaging device contacts the moving web at a distance of less than about 4 inches downstream or upstream from where the straining element contacts the moving web.

21. A winder for winding a web to produce a rolled product comprising:

(a) an unwind station for unwinding the web;

(b) a conveyor belt for conveying the web downstream from the unwind station;

(c) a web break apparatus, the web break apparatus comprising (i) a first rotating device in operative association with a drive device, the drive device for rotating the first rotating device adjacent to the moving web, the first rotating device including a circumference that is configured to move in the same direction as the moving web;

(ii) a web engaging device being positioned to momentarily engage the moving web; and (iii) a straining element located along the circumference of the first rotating device, the straining element having a contact surface that is configured to move at a second speed, the second speed being greater or less than the first speed of the moving web, forming a speed differential between the first speed and the second speed;

wherein, in order to break the moving web, the web engaging device momentarily engages the moving web while the contact surface of the straining element contacts the web at the speed differential that creates strain and breaks the moving web to form a leading edge within the moving web; and (d) a plurality of winding modules positioned along the conveyor belt to receive the leading edge downstream from the web break apparatus.

* * * * *